US010786984B2

(12) United States Patent
Koblinger

(10) Patent No.: US 10,786,984 B2
(45) Date of Patent: Sep. 29, 2020

(54) SEGMENT WHEEL FOR A DEVICE FOR PRINTING ON HOLLOW BODIES

(71) Applicant: KOENIG & BAUER AG, Würzburg (DE)

(72) Inventor: Michael Koblinger, Zellingen (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 16/474,123

(22) PCT Filed: Feb. 1, 2018

(86) PCT No.: PCT/EP2018/052510
§ 371 (c)(1),
(2) Date: Jun. 27, 2019

(87) PCT Pub. No.: WO2018/188830
PCT Pub. Date: Oct. 18, 2018

(65) Prior Publication Data

US 2019/0381787 A1 Dec. 19, 2019

(30) Foreign Application Priority Data

Apr. 13, 2017 (DE) ..... 10 2017 206 392

(51) Int. Cl.
*B41F 17/22* (2006.01)
*B41F 17/28* (2006.01)
*B41F 17/18* (2006.01)

(52) U.S. Cl.
CPC ..... *B41F 17/22* (2013.01); *B41F 17/18* (2013.01); *B41F 17/28* (2013.01)

(58) Field of Classification Search
CPC ..... B41F 17/22; B41F 17/18; B41F 17/28; B41M 1/40; B65D 1/12; B65D 1/165
See application file for complete search history.

(56) References Cited

U.S. PATENT DOCUMENTS 516,620 A 3/1894 Waterston
2,793,588 A * 5/1957 Stempel ..... B41F 27/1237 101/415.1
3,828,668 A * 8/1974 Zugcic ..... B41F 17/22 101/40

(Continued)

FOREIGN PATENT DOCUMENTS

DE 1225201 B 9/1966
DE 2851426 A1 6/1979

(Continued)

OTHER PUBLICATIONS

International Search Report of PCT/EP2018/052510 dated Apr. 16, 2018.

*Primary Examiner* — Matthew G Marini
*Assistant Examiner* — Marissa Ferguson-Samreth
(74) *Attorney, Agent, or Firm* — Mattingly & Malur, PC

(57) ABSTRACT

A segment wheel for a device for printing on hollow bodies has a plurality of segments formed on its circumference. A printing blanket, for printing on the hollow bodies, is, or at least can be, arranged on at least one segment. The segment wheel has a main body, the main body being made from a metal material. The segments are arranged along the circumference of the main body, each at a joint. Each segment is releasably connected to the main body.

16 Claims, 21 Drawing Sheets

03

(56) References Cited

U.S. PATENT DOCUMENTS

| | | | | |
|---|---|---|---|---|
| 4,573,407 | A | 3/1986 | Jeschke | |
| 5,111,747 | A | 5/1992 | Kobler et al. | |
| 5,181,471 | A | 1/1993 | Sillars | |
| 5,233,922 | A | 8/1993 | Stirbis et al. | |
| 5,406,886 | A | 4/1995 | Schneider et al. | |
| 5,970,865 | A * | 10/1999 | Horth | B41F 17/22 101/40 |
| 6,095,045 | A | 8/2000 | Petersen et al. | |
| 6,167,805 | B1 | 1/2001 | Williams et al. | |
| 6,631,673 | B2 | 10/2003 | Aichele | |
| 9,428,637 | B2 * | 8/2016 | Kohler | C08L 23/0815 |
| 2001/0025572 | A1 | 10/2001 | Aichele | |
| 2018/0236780 | A1 * | 8/2018 | Peutl | B41J 3/4073 |
| 2019/0022998 | A1 | 1/2019 | Behnke et al. | |

FOREIGN PATENT DOCUMENTS

| | | | | |
|---|---|---|---|---|
| DE | 3232780 | A1 | 5/1983 | |
| DE | 8912194 | U1 | 11/1989 | |
| DE | 4300683 | A1 | 7/1994 | |
| DE | 19624440 | A1 | 1/1998 | |
| DE | 10160734 | A1 | 7/2002 | |
| DE | 102006004568 | A1 | 8/2007 | |
| DE | 102006048286 | A1 | 4/2008 | |
| DE | 102007052761 | A1 | 5/2008 | |
| DE | 102016201137 | A1 | 7/2017 | |
| EP | 1132207 | A1 | 9/2001 | |
| EP | 1165318 | A1 | 1/2002 | |
| EP | 1911582 | A2 | 4/2008 | |
| JP | 58-118256 | * | 7/1983 | B41F 30/04 |
| JP | 63-207880 | * | 8/1988 | C09J 5/00 |
| WO | 2004/109581 | A2 | 12/2004 | |
| WO | 2011156052 | A1 | 12/2011 | |
| WO | 2012/148576 | A1 | 11/2012 | |
| WO | 2017/129438 | A1 | 8/2017 | |

* cited by examiner

SEGMENT WHEEL FOR A DEVICE FOR PRINTING ON HOLLOW BODIES

CROSS REFERENCE TO RELATED APPLICATIONS

This application is the U.S. National Phase, under 35 U.S.C. § 371, of PCT/EP2018/052510, filed Feb. 1, 2018; published as WO 2018/188830 A1 on Oct. 18, 2018, and claiming priority to DE 10 2017 206 392.0, filed Apr. 13, 2017, the disclosures of which are expressly incorporated herein by reference in their entireties.

FILED OF THE INVENTION

The present invention relates to a segmented wheel of a device for printing on hollow bodies. The segmented wheel has a plurality of segments formed on its periphery. A printing blanket for printing on the hollow bodies is, or at least can be arranged on at least one segment of the segmented wheel.

BACKGROUND OF THE INVENTION

As is known from WO 2012/148576 A1, for example, in a device used in the packaging industry for decorating hollow bodies, each of which has a cylindrical lateral surface, in most cases a plurality of printing units are used. In such cases, each of these printing units transfers a printing ink onto a printing blanket, which is used jointly by these printing units. The lateral surface of the hollow body in question is then decorated with a print motif, e.g. a multicolored print motif, by a relative movement between the lateral surface of the hollow body in question and the printing blanket, in particular by rolling the lateral surface of the hollow body in question along said printing blanket, which has been inked-up in advance, in particular with multiple colors.

A device of this type for printing on or for decorating hollow bodies, each of which has in particular a preferably cylindrical lateral surface, is used, for example, in conjunction with a system for producing such hollow bodies which typically has a plurality of work stations, wherein the hollow bodies are printed on or decorated by means of a printing process, and therefore these hollow bodies may also be referred to generally as printed products. In such a system, the hollow bodies to be printed on are produced in a large-scale production process in which, for example, several hundred or even several thousand pieces are produced per minute, for example between 1500 and 3000 pieces per minute. Hollow bodies of this type are made of metal, in particular steel or aluminum, for example, or are made of plastic. Metal hollow bodies of this type are used, for example, as beverage cans or as aerosol cans. Plastic hollow bodies of this type are produced, e.g. in the form of thermoplastic molded articles and are used, e.g. as cartons for packaging liquid or paste-like food products, for example, especially dairy products or beverages. However, the hollow body may also be a round tubular body made of either a plastic or aluminum, with a tube being defined as an elongated, sturdy but malleable container, which is intended for filling particularly with a paste-like substance. Tubes made of aluminum are produced, e.g. in a backward extrusion process. Tubes made of plastic are produced as seamless tubes, e.g. by means of extrusion. Another possible type of hollow body that can be printed on in a device as described above is containers or vessels, such as bottles or flasks, preferably cylindrical and made of glass.

Beverage cans are preferably made of aluminum and are typically what are known as two-part cans, in which a circular base together with a preferably straight cylinder shell are produced from of a single work piece, i.e. from a slug or from a blank, i.e. a circular disk, in a forming process, for example in a cold extrusion process or in a tensile-pressure forming process, preferably by deep drawing, in particular by deep drawing and ironing, to form a hollow body which is open at one end, known as a can blank, and in which, in a final manufacturing step, a circular lid is placed on the cylinder and is attached to the cylinder by flanging, forming an air-tight seal.

Tinplate cans are another type of can. Tinplate is tin-plated sheet steel. The thickness of the sheet steel used to produce tinplate cans is 0.15 mm to 0.49 mm, for example, and the thickness of the tin plating is 0.2 μm to 0.8 μm, for example; the tin plating provides protection against corrosion. Tinplate cans are what are known as three-part cans. To produce the shell for a tinplate can, a rectangular strip of sheet steel is bent into a preferably straight cylinder, and the ends of this strip that has been bent into a cylinder are welded together at a butt joint. A circular base and a circular lid are then placed onto the cylinder and the edges are flanged. To make the tinplate can in question more resistant to dents, each of the three parts, i.e., the cylinder shell, the base and the lid, preferably has a corrugated profile, for example.

An aerosol can, also called a spray can, is a metal can used for spraying liquids. The liquid filled into an aerosol can is pressurized, and propane, butane, dimethyl ether or mixtures thereof, or compressed air or nitrogen, for example, is used as the propellant for dispensing the liquid from the can.

The aforementioned WO 2012/148576 A1 describes a device for decorating cans, in which an assembly of multiple printing units is provided, each having an inking unit for the multicolored decoration of a plurality of cans, wherein each of the inking units belonging to one of the printing units has an ink fountain for supplying ink, wherein in each ink fountain, an ink fountain roller for picking the printing ink up from the associated ink fountain is provided, wherein in each inking unit, a duct roller is provided, each duct roller receiving printing ink from the ink fountain roller in question, wherein in a roller train situated downstream of the respective duct roller in the inking unit in question, a plurality of oscillating ink distribution rollers and a plurality of ink transfer rollers are provided, each interacting with at least one of the ink distribution rollers, wherein for each inking unit, a plate cylinder having at least one printing plate is provided, and only a single ink forme roller cooperates with each plate cylinder to apply the printing ink.

Known from U.S. Pat. No. 5,233,922 A is a segmented wheel for a device for printing on hollow bodies, in which a plurality of segments is formed on the periphery of said segmented wheel, with a printing blanket for printing on the hollow bodies being arranged on at least one segment, the segmented wheel having a main body, and each segment being arranged pivotably relative to the main body.

DE 1 225 201 B also relates to a segmented wheel for a device for printing on hollow bodies, with a plurality of segments being formed on the periphery of said segmented wheel, a printing blanket for printing on the hollow bodies being arranged on at least one segment, the segmented wheel having a main body, and each segment being arranged pivotably relative to the main body. The segments may be embodied as individual integral parts or as multi-part elements. In the case of a two-part embodiment, the two parts of the relevant segment are connected to one another by means of screws. The segments are connected to the main body via a pivot bearing.

From the subsequently published DE 10 2016 201137 A1, a device for printing on hollow bodies is known, which comprises a segmented wheel having a plurality of segments on its periphery, with a printing blanket for printing on the hollow bodies being arranged on at least one segment of the segmented wheel.

WO 2004/109581 A2 discloses an apparatus for carrying out a contactless digital printing method, e.g. an inkjet printing method, for printing on round objects, in particular two-part cans, individually if necessary, without the use of a printing blanket, in which a plurality of print heads are preferably provided, each of which prints in a single printing ink.

From DE 10 2006 004568 A1, a short inking unit for a printing machine is known, comprising a printing forme cylinder, an ink forme roller cooperating with the printing forme cylinder, and an anilox roller that contacts the ink forme roller and is associated with a device for supplying ink, wherein at least one leveling roller is disposed between the point where ink is supplied and the contact nip between the anilox roller and the ink forme roller with respect to the direction of rotation of the anilox roller, and the device for supplying ink is embodied as a chamber doctor blade.

Known from DE 101 60734 A1 is a printing machine that comprises at least one printing forme, a dampening unit for dampening the printing forme with a dampening medium, an inking unit for inking the printing forme with a printing ink and a dehumidifying device with a heating roller (temperature control roller) for reducing the amount of dampening medium that is conveyed together with the printing ink, wherein the inking unit is embodied as a leverless short inking unit, in which one inking unit roller of the inking unit includes a first rolling contact point at which the inking unit roller is in rolling contact with the heating roller, and the inking unit roller also has a second rolling contact point, and wherein the shortest path along which printing ink is conveyed from the inking unit roller to the printing forme is determined by at most one intermediate roller.

Known from DE 32 32780 A1 is an inking unit for offset printing machines for printing onto sheets or webs, having a plate cylinder that receives the necessary ink from at most two ink forme rollers which have an elastic surface and which cooperate with an inking cylinder to which the ink is fed via an ink feeding system that generates a continuous ink film, wherein an ink forme roller having nearly the same diameter as the plate cylinder is disposed downstream of the inking cylinder, wherein the inking cylinder is associated with a dampening unit having at least one roller for transferring the dampening medium, and wherein the dampening medium is transferred to the inking cylinder in the direction of rotation thereof downstream of the ink application and upstream of the contact point thereof with the ink forme roller.

Known from DE 10 2006 048286 A1 is a method for driving a printing unit which has a short inking unit in a processing machine having an anilox roller and an associated doctor blade device, along with an ink forme roller located downstream of the anilox roller, and a plate/forme cylinder downstream of the ink forme roller in the direction of ink flow, wherein the plate/forme cylinder is operatively connected to a rubber blanket cylinder and the rubber blanket cylinder is operatively connected to a printing cylinder which guides the printing substrate, wherein the anilox roller is driven by an independent drive, wherein during printing/varnishing operation, the main drive supplies an input drive to a drive wheel of the printing cylinder and to a drive wheel of the rubber blanket cylinder and to a second and a first drive wheel of the plate/forme cylinder and to a drive wheel of the ink forme roller and to a drive wheel of the anilox roller, while the independent drive of the anilox roller is inactive, and wherein during set-up operation, the drive connection to the main drive between first drive wheel and second drive wheel of the plate/forme cylinder is disconnected, the independent drive of the anilox roller is activated, and the independent drive applies drive torque to the drive wheel of the anilox roller and to the drive wheel of the ink forme roller and to the first drive wheel of the plate/forme cylinder.

Known from DE 196 24440 A1 is a device for filling depressions in a cylinder of a printing machine with a fluid, wherein at least two doctor blade devices for filling depressions in the cylinder with the fluid are arranged on the cylinder, wherein an applicator for the fluid, connected to a fluid conveyance system, and a working blade disposed downstream of said applicator in the direction of rotation of the cylinder are provided, wherein the doctor blades are mounted on a bar, and the wiped off fluid is discharged to a collecting basin.

Known from DE 89 12194 U1 is an inking unit for use in a printing machine, having a working doctor blade that can be set against an anilox roller, along with an ink trough with ink conveying means, wherein the working doctor blade, the ink trough and the means for conveying the ink to the anilox roller are combined to form a single modular unit and the modular unit is removably attachable to a carrier structure mounted on the printing machine.

Known from DE 10 2007 052761 A1 is an anilox printing unit, which includes an ink forme roller and an anilox roller as inking unit rollers, the anilox roller being mounted on rocking levers, wherein the anilox roller and the ink forme roller each have bearer rings, and a device for pressing the bearer rings of one inking unit roller against the bearer rings of the other inking unit roller includes springs to compensate for diameter differences resulting from manufacturing tolerances.

DE 43 00683 A1 discloses an inking unit of a rotary printing press, having an ink forme roller with annular grooves formed in its lateral surface.

A distribution roller having a plurality of pliable rings arranged side by side in the axial direction is known from U.S. 516,620.

Known from DE 28 51426 A1 is a device for printing on the lateral surface of hollow bodies, wherein a transport device is provided for transporting the hollow bodies to be printed about a rotational axis, wherein a plurality of printing units are provided, wherein each hollow body to be printed on can be transported by means of the transport device into the printing zone of at least one of the printing units, and wherein at least one of the printing units has a printing forme cylinder and an inking unit having a single ink forme roller.

SUMMARY OF THE INVENTION

The object of the present invention is to devise a segmented wheel for a device for printing on hollow bodies, with which a production adjustment to a different format of hollow body can be carried out economically. Even smaller lot sizes, which lead to a frequent resetting of the production system due to the need to change the decorative pattern after short production periods, should be able to be produced economically and efficiently.

The object of the present invention is attained, according to the present invention, by a segmented wheel having a main body, wherein the main body is made of a metallic material. Each of the segments which is formed along the periphery of the main body is arranged at a joint. The segments are each detachably connected to the main body.

BRIEF DESCRIPTION OF THE DRAWINGS

One exemplary embodiment of the invention is illustrated in the set of drawings and will be described in greater detail below. Advantages to be achieved with the invention will be mentioned in connection with the exemplary embodiment.

In the figures.

DESCRIPTION OF THE PREFERRED EMBODIMENT

Figure 1:
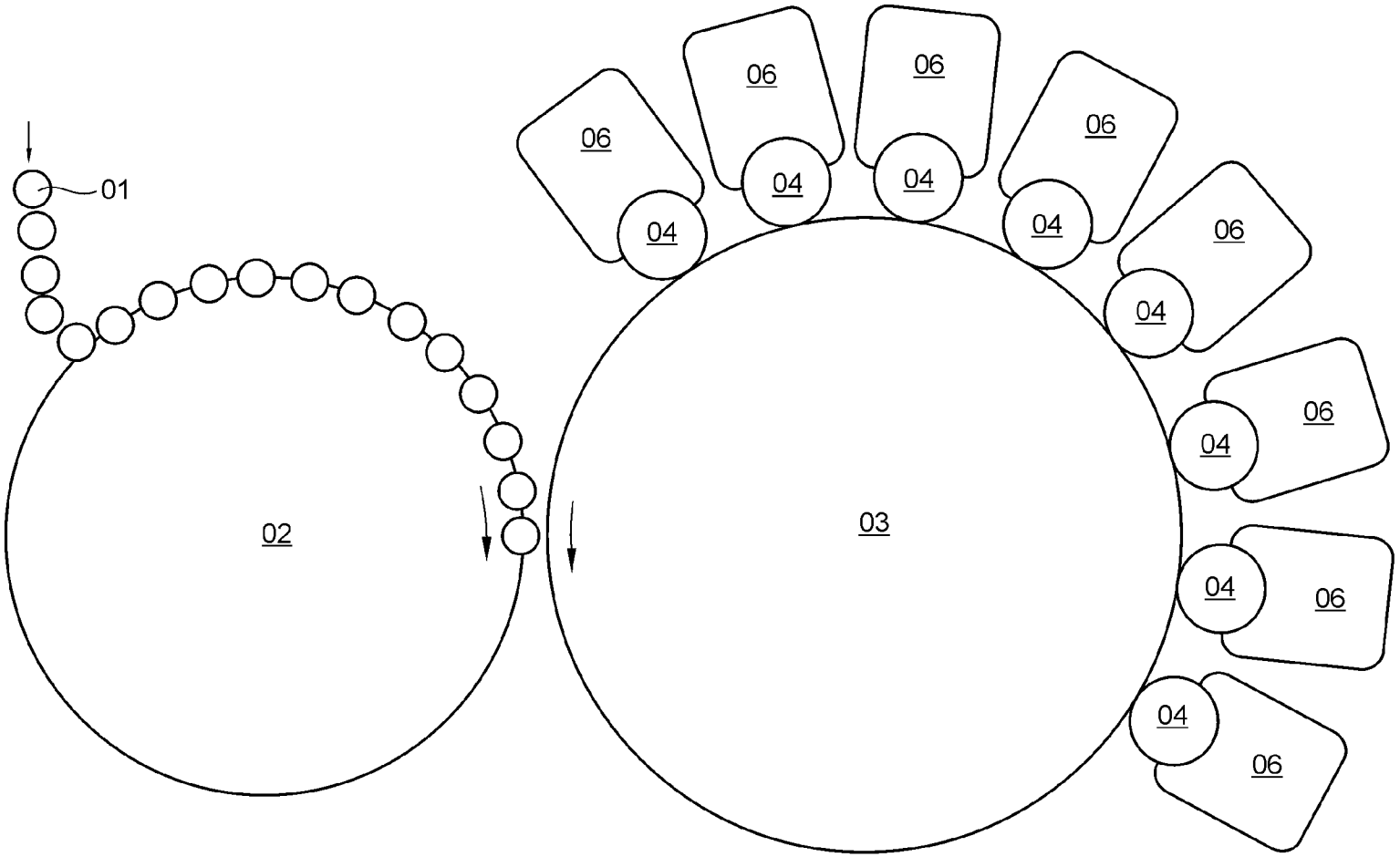
FIG. 1 shows a device for printing on or for decorating hollow bodies, each of which has a lateral surface.

In a preferred embodiment, the printing, in particular, of the lateral surface of a hollow body with, e.g. a multicolor print motif, i.e. at least one printed image, is carried out in a letterpress process. Alternative printing methods include, e.g., a screen printing process or an offset printing process or a digital printing process without printing formes. In the following, the invention will be described by way of example in connection with a letterpress process. To execute the letterpress process, a printing plate is arranged as a printing forme on the lateral surface of a plate cylinder. The printing plate ready for use in the printing process is a printing forme with a print relief, said print relief reproducing the print image intended for use in the printing process in a mirror image, wherein in an error-free printing operation, only the print relief is involved in the transfer of ink that has been supplied by the inking unit to the plate cylinder onto the printing blanket. The printing forme or the printing plate has a plate-shaped, preferably flexible substrate of finite length, e.g. made from a steel sheet, wherein a printing element, in particular flexible, is arranged on said substrate. At least the opposing ends of the substrate in the circumferential direction of the plate cylinder may be either precurved, e.g. corresponding to the curvature of the lateral surface of the plate cylinder, or bent, to enable easier mounting of the printing forme, i.e. here in particular the printing plate, on the plate cylinder. The substrate of the printing forme or the printing plate has a thickness ranging from 0.2 mm to 0.3 mm, for example. The total thickness of the printing plate, including its substrate, ranges from 0.7 mm to 1.0 mm, for example, and is preferably approximately 0.8 mm. The printing element is made of a plastic, for example. To produce the printing plate which is ready for use in the printing process, the printing element is exposed, e.g. with a negative film that mirrors the print image, and unexposed areas are then removed from the printing element, e.g. by washing or by means of a laser.

A device for printing on or decorating hollow bodies, each of which has in particular a preferably cylindrical lateral surface, preferably has a plurality of printing units, e.g. eight or ten or even more—also called printing stations—, wherein at least one of these printing units, and in the preferred embodiment each of these printing units, has a rotatable printing forme cylinder, in particular a printing forme cylinder configured as a plate cylinder. The printing units or printing stations and optionally also the printing forme cylinders in this device are each mounted in a frame and can be used in the same printing process to produce a print motif in multiple colors on the same hollow body, the number of colors corresponding to the number of printing units or printing forme cylinders involved. Each printing forme cylinder or plate cylinder is preferably mounted as a cantilevered component, with the printing forme cylinder or plate cylinder in question being mounted at one of its end faces, e.g. on a preferably conical journal. Typically, only a single printing plate is arranged on the lateral surface of each plate cylinder, with the substrate of the printing plate fully or at least largely spanning the circumference of the plate cylinder in question, in particular more than 80% thereof. The length of the printing element of the printing plate in the circumferential direction of the plate cylinder in question is preferably shorter than the circumference of the plate cylinder in question. The printing forme or the printing plate is or at least can be arranged by means of its substrate, in particular magnetically, on the lateral surface of any of the plate cylinders, i.e. the printing forme or the printing plate is preferably held there magnetically, i.e. by means of a magnetic holding force. In an alternative or additional variant of the device for printing on or decorating hollow bodies, each of which has a preferably cylindrical lateral surface, at least one of the printing units, or each of a plurality of these printing units, is configured as a printing unit that prints in a digital printing process without the use of printing formes, with such a printing unit having, in particular, at least one inkjet print head or one laser.

The especially simultaneous transfer of a plurality of printing inks in particular to the lateral surface of the hollow body in question requires proper register to be maintained during ink transfer in order to achieve good print quality in the printing process. For a true-to-register arrangement of the printing forme or the printing plate on the lateral surface of the printing forme cylinder or plate cylinder in question, in the preferred embodiment a plurality of register pins, e.g. the position of each being adjustable, are preferably provided on the lateral surface of the printing forme cylinder or plate cylinder in question, which pins engage in corresponding recesses formed on the printing forme or on the printing plate, thereby giving the printing forme or printing plate a defined position in its arrangement on the lateral surface of the printing forme cylinder or plate cylinder in question. In a preferred embodiment, each printing forme cylinder or plate cylinder has a diameter of between 100 mm and 150 mm, in particular between 120 mm and 130 mm, and the axial length of each printing forme cylinder or plate cylinder is between 200 mm and 250 mm, for example, in particular between 200 mm and 220 mm. The printing plate to be arranged on the lateral surface of the plate cylinder in question has a width in the axial direction of the plate cylinder in question that ranges from 150 mm to 200 mm, and is preferably about 175 mm.

Each printing forme cylinder, e.g. configured as a plate cylinder, used in the printing process uses its printing forme or its printing plate to transfer a specific printing ink onto a printing blanket. The printing inks used are typically premixed, in particular specially customized inks, which are specifically adapted in terms of their respective printability to the material of the hollow body to be printed on, depending upon whether the surface to be printed on is made e.g. of aluminum, tinplate, or plastic. In a preferred embodiment of a device for printing on or decorating hollow bodies, each of which has, e.g. a cylindrical lateral surface, a device for transferring printing ink from the printing forme or the printing plate to the lateral surface of the hollow body in question is provided. This device for transferring ink is preferably embodied, e.g. as a segmented wheel that rotates about a horizontal axis, in particular, wherein a plurality of printing blankets, e.g. eight, ten, twelve or even more, preferably are or at least can be arranged one behind the other on the periphery of this segmented wheel, i.e. along its circumference. As an alternative to the segmented wheel, and depending on the printing method that is used, the device for transferring printing ink may also be embodied as a decorating drum or as a printing blanket cylinder or as a transfer cylinder, each of which is rotatable about an axis of rotation, at least during printing. The printing blankets have hitherto been arranged on the periphery of the segmented wheel by attaching each of the printing blankets to the periphery of the segmented wheel, e.g. by an adhesive connection, preferably by gluing. Each of the preferably multiple printing forme cylinders or plate cylinders is or at least can be thrown radially onto the printing blankets that are arranged on the periphery of the segmented wheel in question. In a particularly preferred embodiment of a device for printing on or decorating hollow bodies, each of which has, e.g. a cylindrical lateral surface, a greater number of printing blankets are provided one behind the other along the periphery of the segmented wheel than the number of printing forme cylinders or plate cylinders which are or at least can be thrown radially onto the segmented wheel. The device for transferring printing ink, preferably in the form of a carousel, in particular the segmented wheel, has a diameter of, e.g. 1,400 mm to 1,600 mm, preferably of about 1,520 mm to 1,525 mm, and when e.g. eight printing forme cylinders or plate cylinders are assigned to said device, it has e.g. twelve printing blankets arranged one behind the other around its periphery. The surface of each printing plate is preferably configured as harder than the respective surface of the printing blankets. The surface of the printing blankets is preferably flat, i.e. without profiling. In an operating mode in which the printing forme cylinders or plate cylinders involved in the printing process are each thrown radially onto the printing blankets of the rotationally driven segmented wheel, the respective printing formes of these printing forme cylinders or the respective printing plates of these plate cylinders roll along the printing blankets that are moved by the segmented wheel, with each of the printing plates pressing at least its print relief, e.g. 0.2 mm to 0.25 mm deep into the respective printing blanket, thereby producing a flattened area in the printing blanket in question, i.e. a roller strip, extending in the axial direction of the segmented wheel. The intensity of this flattening is or can be adjusted, e.g. prior to or at the start of a printing process, e.g. by means of remote actuation, by adjusting the contact pressure exerted by the printing forme cylinder or plate cylinder in question on the printing blanket in question of the segmented wheel.

Each of the hollow bodies to be printed on here by way of example, e.g. each of the two-part cans to be printed on, is moved, e.g. by means of a transport device that preferably transports the hollow bodies to be printed on along at least a portion of a circular path, that is, a circular arc, around a rotational axis, preferably by means of a feed wheel, in particular by means of a mandrel wheel, in a continuous movement or in a set cycle, up to at least one of the printing units belonging to the device for printing on hollow bodies, each of which has a lateral surface, and is thereby transported into the printing zone of at least one of these printing units. For example, each of the hollow bodies to be printed on is moved by means of the transport device, e.g. embodied as a feed wheel, up to at least one of the printing blankets arranged, e.g. on the segmented wheel, or each of the hollow bodies to be printed on is transported directly and immediately, i.e. without assistance from a device for transferring printing ink, e.g. embodied as a segmented wheel, into the respective printing zone of at last one of these printing units, which is the case when the printing unit in question prints in a direct printing process, for example in an inkjet printing process.

The feed wheel or mandrel wheel which, like e.g. the segmented wheel, rotates about a preferably horizontal axis, has a plurality of holders, e.g. 24 or 36, concentrically to its circumferential line in preferably equidistant distribution, e.g. each in the form of a clamping mandrel or a spindle that projects cantilevered from an end face of the mandrel wheel, wherein each holder holds or at least is capable of holding one of the hollow bodies to be printed on. A transport device embodied as a mandrel wheel is also characterized herein as a turntable with spindles. A mandrel wheel is described, e.g. in EP 1165318 A1. A description of suitable holders, spindles and/or clamping mandrels may be found in WO 2011/156052 A1, for example. In the following, each clamping mandrel will be referred to simply as a mandrel. The longitudinal axis of each mandrel is oriented parallel to the axis of the mandrel wheel. In the case involving printing on hollow bodies, each of which is embodied, e.g. as a two-part can, each of these hollow bodies is moved, e.g. by means of a conveyor device, e.g. a belt conveyor, up to the transport device, embodied e.g. as a mandrel wheel, where it is inverted at a transfer station onto one of the mandrels of the mandrel wheel by suction, e.g. by means of a vacuum, and is then held by the mandrel in question, while the transport device embodied as a mandrel wheel transports the respective hollow body to be printed on, e.g. to the segmented wheel which is loaded with at least one printing blanket and thus in the direction of at least one of the printing units, or in an alternative embodiment that has no segmented wheel, for example, directly to at least one of the printing units. Typically, a large number of hollow bodies to be printed on are fed to the mandrel wheel in rapid succession by the conveyor device. A conveyor device of this type is described, e.g. in EP 1132207 A1.

A gap measuring less than 1 mm in width, e.g. measuring 0.2 mm in width, is preferably formed between the inner wall of a respective hollow body to be printed on and the surface of the relevant mandrel of the mandrel wheel, so that the hollow body to be printed on is not held on the mandrel in question by means of a press fit. Each mandrel can be rotated about its respective longitudinal axis, e.g. by means of a motor, and in particular is adjustable to a specific circumferential speed, so that in addition to being rotated by the mandrel wheel, each hollow body to be printed on that is held by a mandrel can be rotated by a rotation that is or at least can be executed independently by the mandrel. The hollow body to be printed on is preferably inverted onto one of the mandrels of the mandrel wheel during a phase when the mandrel in question is stationary; during said stationary phase, the mandrel in question executes no rotational movement about its own longitudinal axis. The loading of each mandrel with a hollow body to be printed on is preferably verified, e.g. in a contactless manner by means of a sensor. If a mandrel is not loaded with a hollow body to be printed, the mandrel wheel will moved, e.g. in such a way that contact of the unoccupied mandrel with a printing blanket of the segmented wheel is reliably prevented.

Before being fed, e.g. to the mandrel wheel, two-part cans to be printed on are produced, e.g. deep-drawn from a circular blank, in a processing station disposed upstream of the mandrel wheel. In an additional processing station, the rim of each two-part can is trimmed at its open end face. In additional processing stations, each two-part can is washed, for example, in particular its inside is washed out, and optionally, the inner wall and the base of the two-part can in question is also coated. At least the exterior lateral surface of each two-part can is primed, for example, in particular with a white primer. Once the printing on its lateral surface is complete, each two-part can is removed from its respective holder, e.g. on the mandrel wheel, e.g. by means of compressed air or by means of a preferably reversible magnet, and is fed to at least one processing station located downstream of the mandrel wheel, e.g. to a coating station for coating the exterior lateral surface of each printed two-part can and/or to a rim processing station. The printed two-part cans pass in particular through a dryer, e.g. a hot air dryer, to cure the at least one printing ink applied to their respective lateral surfaces.

The printing process for printing in particular on the lateral surfaces of hollow bodies, in particular two-part cans, held, e.g. on the mandrel wheel, begins with each of the printing inks that are required for the print image to be printed onto the lateral surface of each hollow body being applied, e.g. by the respective printing plate of the plate cylinder that is thrown, e.g. onto the segmented wheel, to the same one of the printing blankets arranged on the periphery of the segmented wheel. The printing blanket in question, inked up in this manner with all the necessary printing inks, then transfers these printing inks simultaneously onto the lateral surface of the hollow body to be printed on by means of direct surface contact between the printing blanket and the lateral surface of the hollow body to be printed on during a single revolution of said hollow body to be printed on about its longitudinal axis, said hollow body being held on one of the mandrels of the mandrel wheel. During the transfer of the printing inks from the printing blanket onto the lateral surface of the hollow body, the hollow body to be printed on, held, e.g. by one of the mandrels of the mandrel wheel, rotates at the same circumferential speed as the printing blanket in question, arranged, e.g. on the periphery of the segmented wheel. The respective circumferential speeds of hollow body and printing blanket or segmented wheel are thus synchronized with one another, with the hollow body to be printed on, which is held, e.g. on one of the mandrels of the mandrel wheel, being accelerated appropriately, e.g. starting from a stationary position, beginning from its first point of contact with the relevant printing blanket and continuing as its lateral surface rolls along a path of the first, e.g. 50 mm of the circumferential length of the printing blanket, in particular until it reaches the circumferential speed, e.g. of the segmented wheel. The segmented wheel that carries the printing blanket in question therefore determines the circumferential speed to be set, e.g. at the respective mandrel of the mandrel wheel. The circumferential speed of the printing forme cylinder that carries the printing forme or of the plate cylinder that carries the printing plate also preferably is or will be adjusted based upon the circumferential speed, e.g. of the segmented wheel. The mandrel wheel and the segmented wheel can be driven, e.g. by the same central machine drive and are optionally coupled to one another mechanically, e.g. via a gear set. In the embodiment according to the invention, however, the mandrel wheel and the segmented wheel are each driven individually by a separate drive, and the respective rotational behavior of each is controlled or regulated by a control unit.

In the following, various details relating, in particular, to the above-described device for printing on or decorating hollow bodies each of which has, e.g. a cylindrical lateral surface will be described by way of example. FIG. 1 shows a simplified schematic representation of an example of a generic device for printing on or decorating hollow bodies 01, e.g. two-part cans 01, each having a preferably cylindrical lateral surface, in particular, wherein said hollow bodies 01 are fed, e.g. sequentially, by a conveyor device to the transport device configured, e.g. as a rotating or at least rotatable feed wheel, in particular as a mandrel wheel 02, and are held on said transport device, each on a single holder. In the following, based upon the selected exemplary embodiment of the printing machine or the device for printing on hollow bodies, it will be assumed that this transport device is configured preferably as a mandrel wheel 02. A device for transferring printing ink, e.g. a rotating or at least rotatable segmented wheel 03, around the periphery of which a plurality of printing blankets are arranged one behind the other, preferably cooperates with mandrel wheel 02. Assigned to segmented wheel 03, mentioned by way of example, and arranged along its circumferential line, a plurality of printing forme cylinders, in particular plate cylinders 04, that are or at least can be thrown radially onto this segmented wheel 03 are provided, with a printing forme, in particular a printing plate, being arranged on the lateral surface of each of these printing forme cylinders or plate cylinders 04, said printing plate being suitable in particular for carrying out a letterpress printing process. A specific printing ink is fed by means of an inking unit 06 to each of the printing forme cylinders or plate cylinders 04 for the purpose of inking up the printing forme or printing plate thereof. In the following, it will be assumed by way of example that each of the printing forme cylinders is configured as a plate cylinder 04 that carries at least one printing plate.

Figure 2:
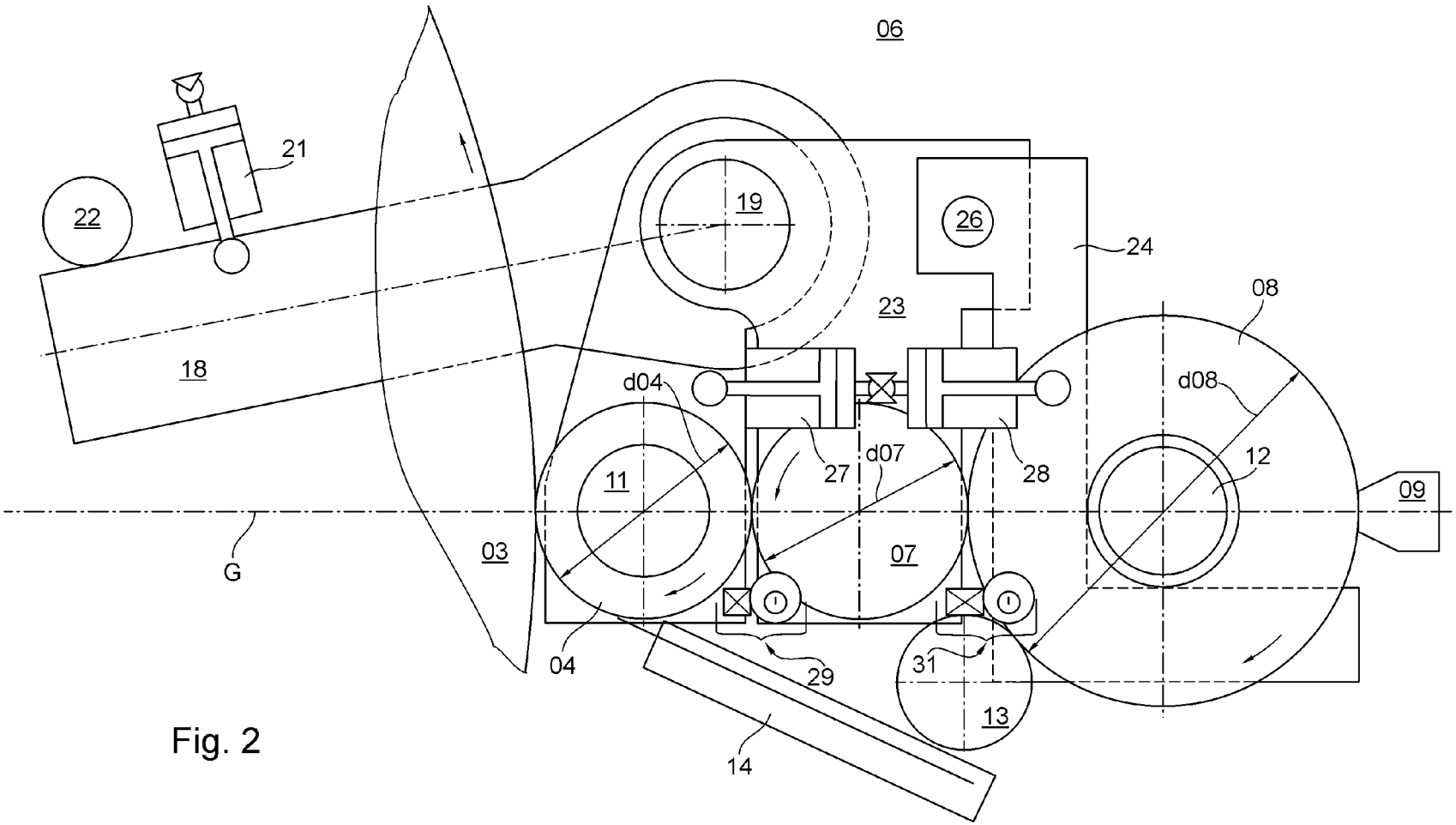
FIG. 2 shows an inking unit, in particular for the device shown in FIG. 1, in a first operating position.
Figure 3:
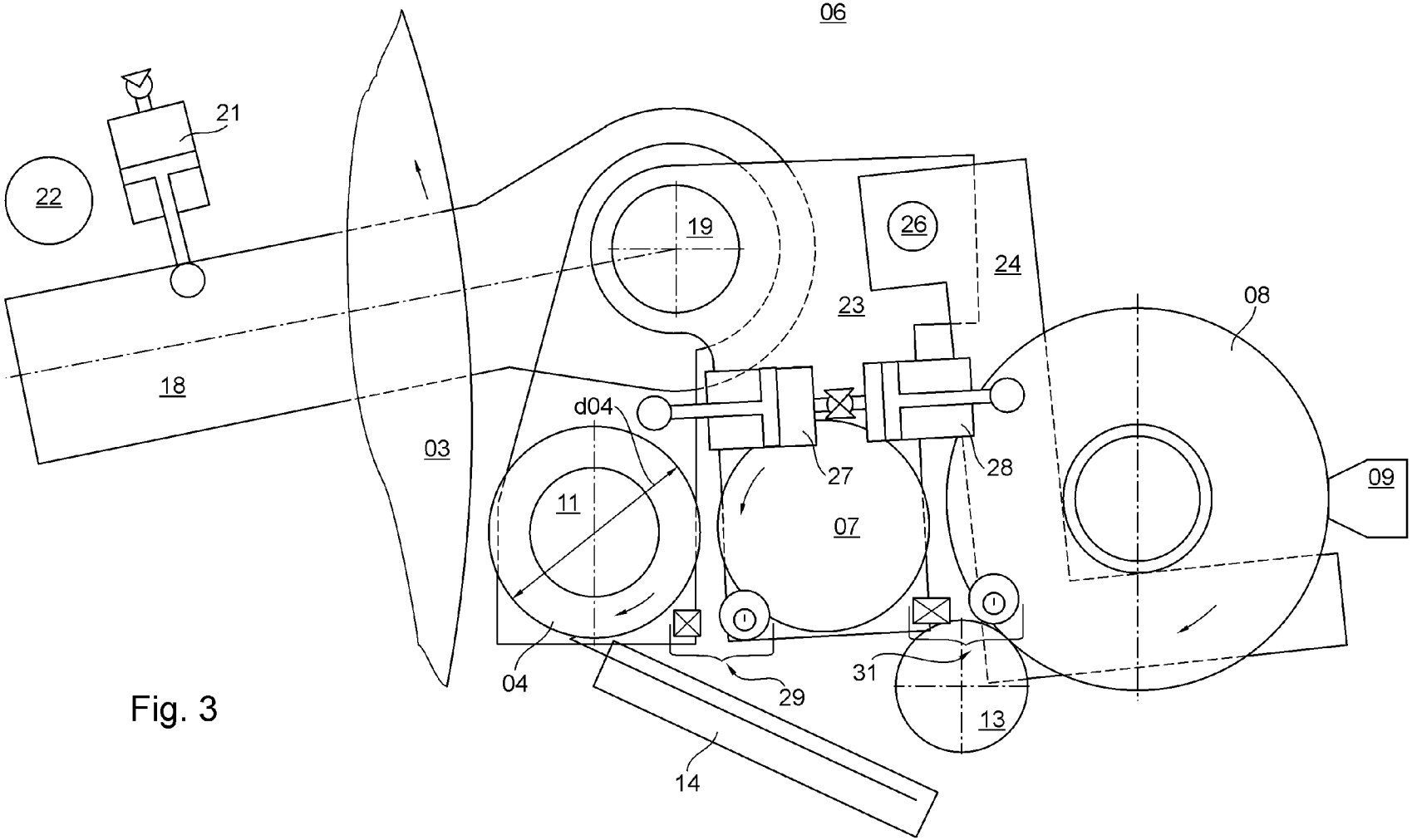
FIG. 3 shows the inking unit in particular for the device shown in FIG. 1 in a second operating position.

FIGS. 2 and 3 show a simplified schematic representation of a number of details of inking unit 06, one of which cooperates with each plate cylinder 04, and which is provided, e.g. for use in the device shown in FIG. 1 for printing on or decorating in particular hollow bodies 01, each having a preferably cylindrical lateral surface. The inking unit 06 proposed here advantageously has a very short roller train, i.e. consisting of only a few rollers, preferably a maximum of five, in particular a two-roller train, for transporting ink from an ink reservoir to the relevant plate cylinder 04. In the case of a two-roller train, said roller train consists of only a single ink forme roller 07 and one anilox roller 08. An inking unit 06 with a roller train consisting of no more than five rollers is classified as a short inking unit. FIG. 2 shows an example of a (short) inking unit 06 having a two-roller train in a first operating position, in which ink forme roller 07 and anilox roller 08 are thrown onto one another, ink forme roller 07 is thrown onto plate cylinder 04, and plate cylinder 04 is thrown radially onto the device, in particular the segmented wheel 03, for transferring printing ink from plate cylinder 04 onto the lateral surface of the hollow body 01 in question. In contrast, FIG. 3 shows a second operating position for the inking unit 06 shown in FIG. 2, in which ink forme roller 07 and anilox roller 08 are thrown off of one another, ink forme roller 07 is thrown off of plate cylinder 04, and plate cylinder 04 is thrown off of the device for transferring printing ink, in particular the segmented wheel 03. The throw-on and throw-off mechanism will be described further below.

Plate cylinder 04 and anilox roller 08 are each rotated, e.g. separately, each by a motor 11; 12, in particular in the preferred inking unit 06 as shown in FIGS. 2 and 3, in which the motor 11; 12 in question is in particular controlled or at least controllable, e.g. in terms of its respective speed, by e.g. an electronic control unit. The device for transferring printing ink, configured, e.g. as a segmented wheel 03, is rotationally driven by a dedicated drive in the preferred embodiment or by a central machine drive in an embodiment not according to the invention. Ink forme roller 07 is or is to be rotationally driven by anilox roller 08 by means of friction or likewise separately by a motor. In the preferred embodiment, the outer diameter d07 of ink forme roller 07 is equal to the outer diameter d04 of plate cylinder 04, which carries at least one printing forme, in particular at least one printing plate. At least one printing plate is or at least can be arranged on the lateral surface of plate cylinder 04, so that in the embodiment in which the outer diameters d04; d07 are equal, the circumferential lengths of plate cylinder 04, which carries the printing plate, and ink forme roller 07 are also equal. In the preferred embodiment, when the inking unit 06 that cooperates with the plate cylinder 04 is in the first operating position, in which ink forme roller 07 and anilox roller 08 are thrown onto one another, ink forme roller 07 is thrown onto plate cylinder 04, and plate cylinder 04 is thrown onto segmented wheel 03, at least the centers of plate cylinder 04, ink forme roller 07 and anilox roller 08 are arranged along the same straight line G. To detect the rotation of ink forme roller 07, a detection device, e.g. in the form of a rotary encoder is provided, said rotary encoder being rigidly connected, in particular, to the shaft of ink forme roller 07. The signal generated by the rotary encoder with a rotation of ink forme roller 07 is used by the control unit to adjust or if necessary to track the rotational speed of ink forme roller 07 by means of the rotation of anilox roller 08 such that synchronization between plate cylinder 04 and ink forme roller 07 is or is to be established, and therefore such that the circumferential speed of ink forme roller 07 coincides with the circumferential speed of plate cylinder 04 within predefined permissible tolerance limits. To achieve this goal, it may be provided that the control unit adjusts the circumferential speed of anilox roller 08, preferably during the adjustment phase carried out by the control unit, in such a way that the anilox roller has a lead or lag time relative to the circumferential speed of plate cylinder 04, in particular briefly, and thus not permanently. By configuring plate cylinder 04 and ink forme roller 07 as having equal circumferential lengths, and by establishing synchronization between plate cylinder 04 and ink forme roller 07, the adverse effect on print quality of ghosting is largely avoided. The drive concept described herein involving a friction-driven ink forme roller 07 also has the advantage that a separate drive for ink forme roller 07 is not required, which saves on cost and also facilitates replacement of ink forme roller 07, e.g. during maintenance and repair operations, due to the simpler mechanical construction. In its preferred embodiment, ink forme roller 07 has a closed, preferably rubberized lateral surface. The lateral surface of anilox roller 08 is coated, e.g. with a ceramic, with a hachure, e.g. of 80 lines per centimeter of axial length of anilox roller 08 or a saucer structure being formed in the ceramic layer. To enable the largest possible volume of printing ink to be fed into the roller train of inking unit 06 with each revolution of anilox roller 08, the outer diameter d08 of anilox roller 08 is preferably configured as larger than the outer diameter d07 of ink forme roller 07. This is meant to give anilox roller 08 the greatest possible delivery volume. In FIG. 2, the directions of rotation of segmented wheel 03, plate cylinder 04, ink forme roller 07, and anilox roller 08 are each indicated by a rotational arrow.

In the preferred embodiment, at least anilox roller 08 has a temperature control device for controlling the temperature of the lateral surface of anilox roller 08. The temperature control device of anilox roller 08 operates e.g. using a temperature control fluid that is introduced into the interior of anilox roller 08, the temperature control fluid being, e.g. water or some other liquid coolant. The temperature control device of anilox roller 08 can be used to influence the delivery volume of anilox roller 08, as said device influences the viscosity of the printing ink to be transported by inking unit 06. The delivery volume of anilox roller 08 and the viscosity of the printing ink to be transported by inking unit 06 in turn ultimately impact the ink density of the printing ink to be applied to the cylindrical lateral surface of the hollow body 01 to be printed on. The thickness of the ink film formed by the printing ink to be applied to the cylindrical lateral surface of hollow body 01 to be printed on is, e.g. less than 10 μm, in particular approximately 3 μm.

Figure 4:
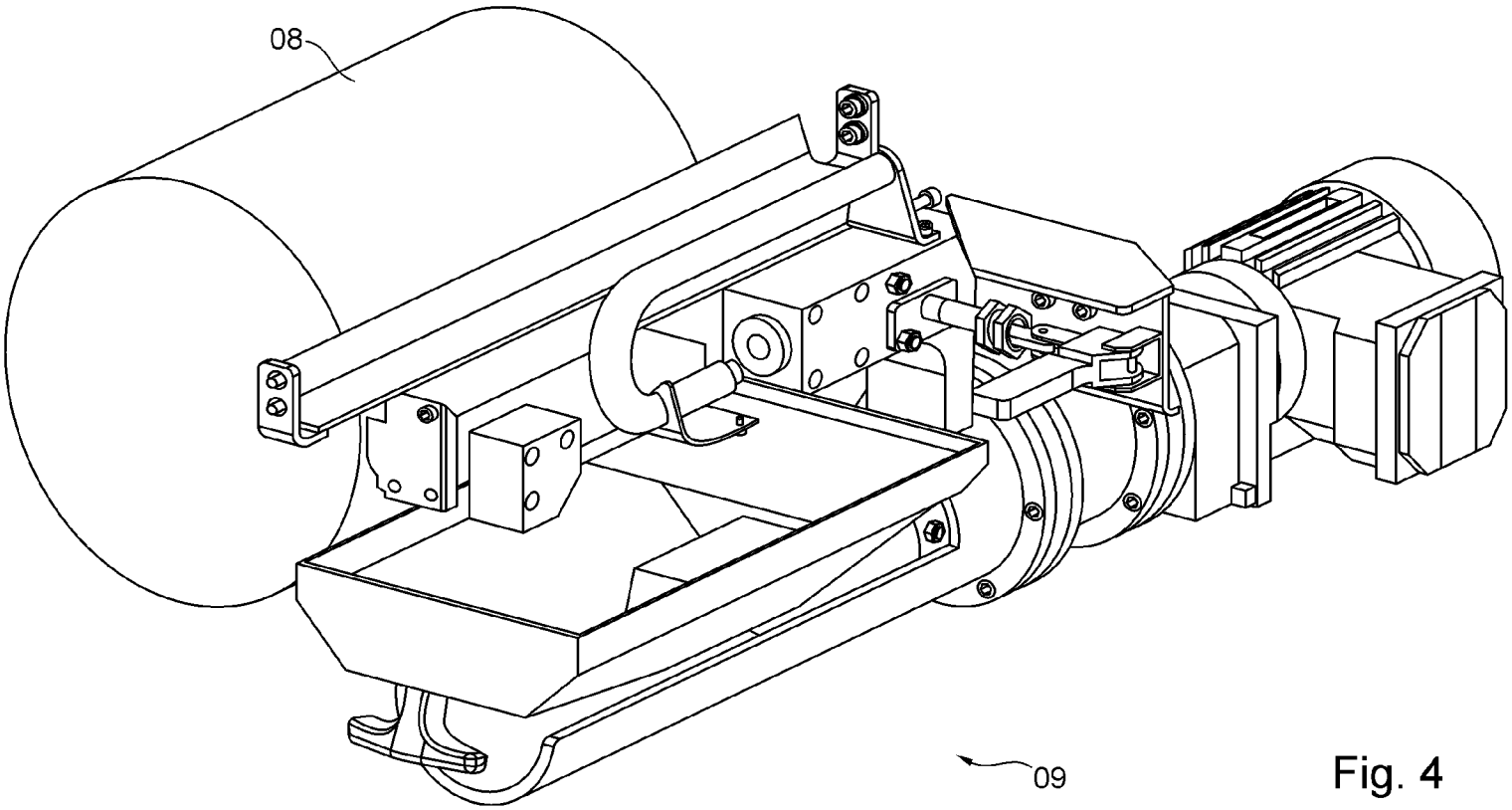
FIG. 4 shows a chamber doctor blade system, in particular for the inking unit shown in FIGS. 2 and 3.

The ink reservoir of inking unit 06 is embodied, e.g. as a chamber doctor blade system 09 that operates in conjunction with anilox roller 08. Advantageously, in this chamber doctor blade system 09, at least one ink trough, a doctor blade bar which is or at least can be set axially parallel against anilox roller 08, and preferably also a pump for delivering the printing ink form a single structural unit. This chamber doctor blade system 09 is held or mounted in inking unit 06, i.e. on a frame of inking unit 06, preferably on only one side, e.g. by means of a suspension, so that once this modular unit has been released from the frame of inking unit 06 it can be removed from inking unit 06 in a simple manner laterally, i.e. by a movement directed axially parallel to anilox roller 08, e.g. by pulling on a handle disposed on said structural unit, and can thereby be replaced. This modular unit of chamber doctor blade system 09 preferably forms a cantilever arm on a side frame of inking unit 06. FIG. 4 shows a perspective view of chamber doctor blade system 09, configured as a separate modular unit, in cooperation with anilox roller 08 of inking unit 06.

Once anilox roller 08 has received printing ink from the ink reservoir, i.e. in particular from chamber doctor blade system 09, anilox roller 08 transports this printing ink immediately and directly or via additional rollers of the roller train which is part of inking unit 06 to the preferably only one ink forme roller 07. In a region downstream of the chamber doctor blade system 09, which is set against anilox roller 08, between chamber doctor blade system 09 and ink forme roller 07 in the direction of rotation of anilox roller 08, a rider roller 13 preferably is or at least can be thrown onto anilox roller 08 for the purpose of improving the transport of ink by anilox roller 08. Rider roller 13 is arranged axially parallel to anilox roller 08. Rider roller 13 is not considered to be part of the roller train of inking unit 06 because it does not transfer printing ink from anilox roller 08 to another roller. Rider roller 13, which is rotationally driven by anilox roller 08, e.g. by means of friction, has a rubberized lateral surface, for example. As rider roller 13, which is thrown onto anilox roller 08, rolls along the lateral surface of anilox roller 08, it draws a portion of the printing ink that has been received by anilox roller 08 from chamber doctor blade system 09 out of the hachure or the saucers of anilox roller 08 and deposits at least some of this printing ink onto lands that are formed on the lateral surface of anilox roller 08. Rider roller 13 rolling along anilox roller 08 thus causes anilox roller 08 to deliver a greater volume of printing ink to ink forme roller 07. As a further consequence, an anilox roller 08 that includes, e.g. a temperature control device also improves the efficacy of controlling the ink density in that the rider roller 13 rolling along anilox roller 08 contributes to supplying a greater volume of printing ink. Regardless of the specific configuration of anilox roller 08, i.e. with or without a temperature control device, rider roller 13 rolling along anilox roller 08 thus reduces both differences in density that can arise due to manufacturing tolerances of the anilox roller 08 and the risk of the hachure or saucers of anilox roller 08 being visible on the printing substrate, i.e. in this case on the lateral surface of the hollow body 01 to be printed on, due to an insufficient application of ink, at least in some areas.

Figure 5:
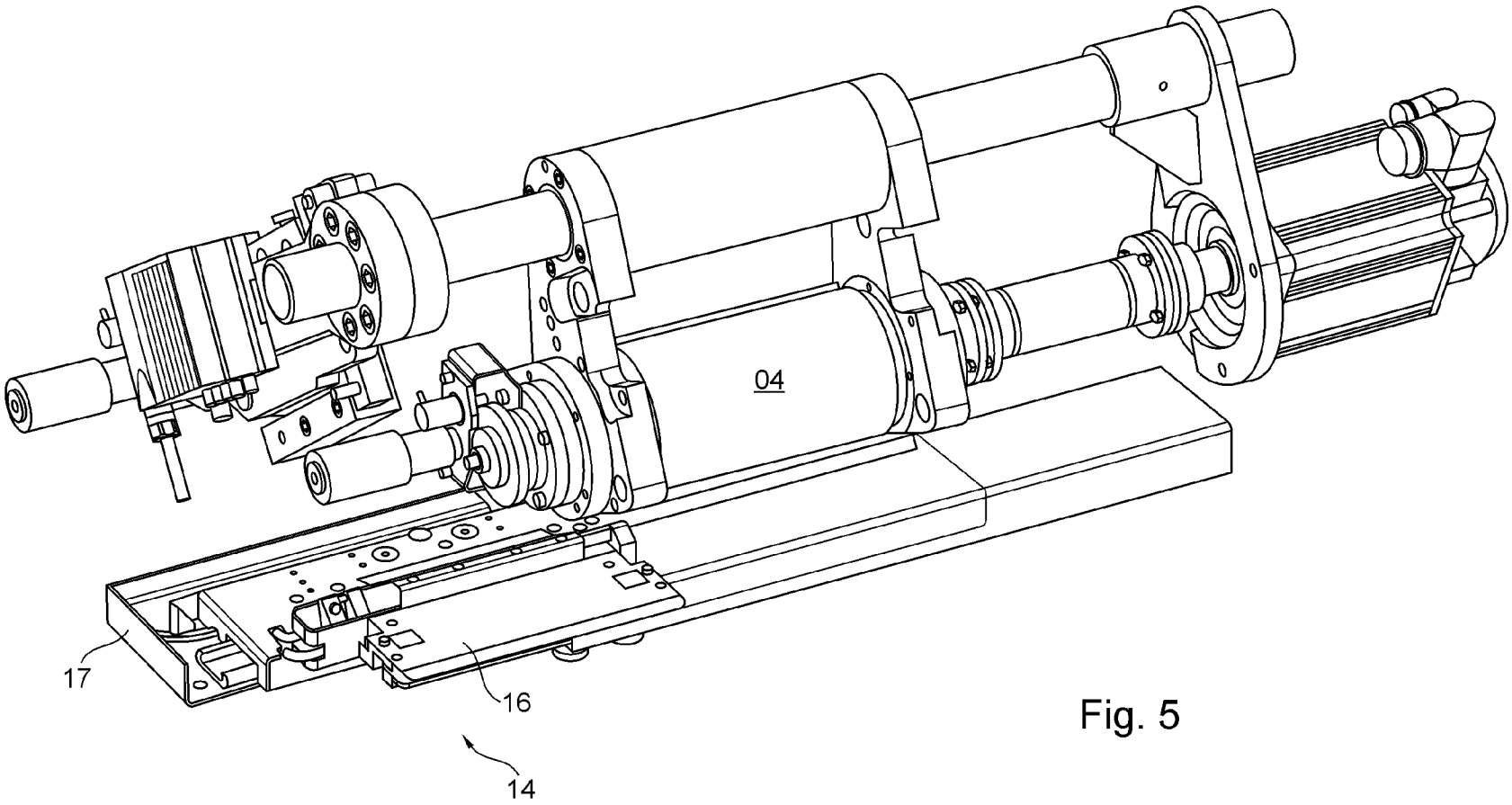
FIG. 5 shows a plate changer in a first operating position.
Figure 6:
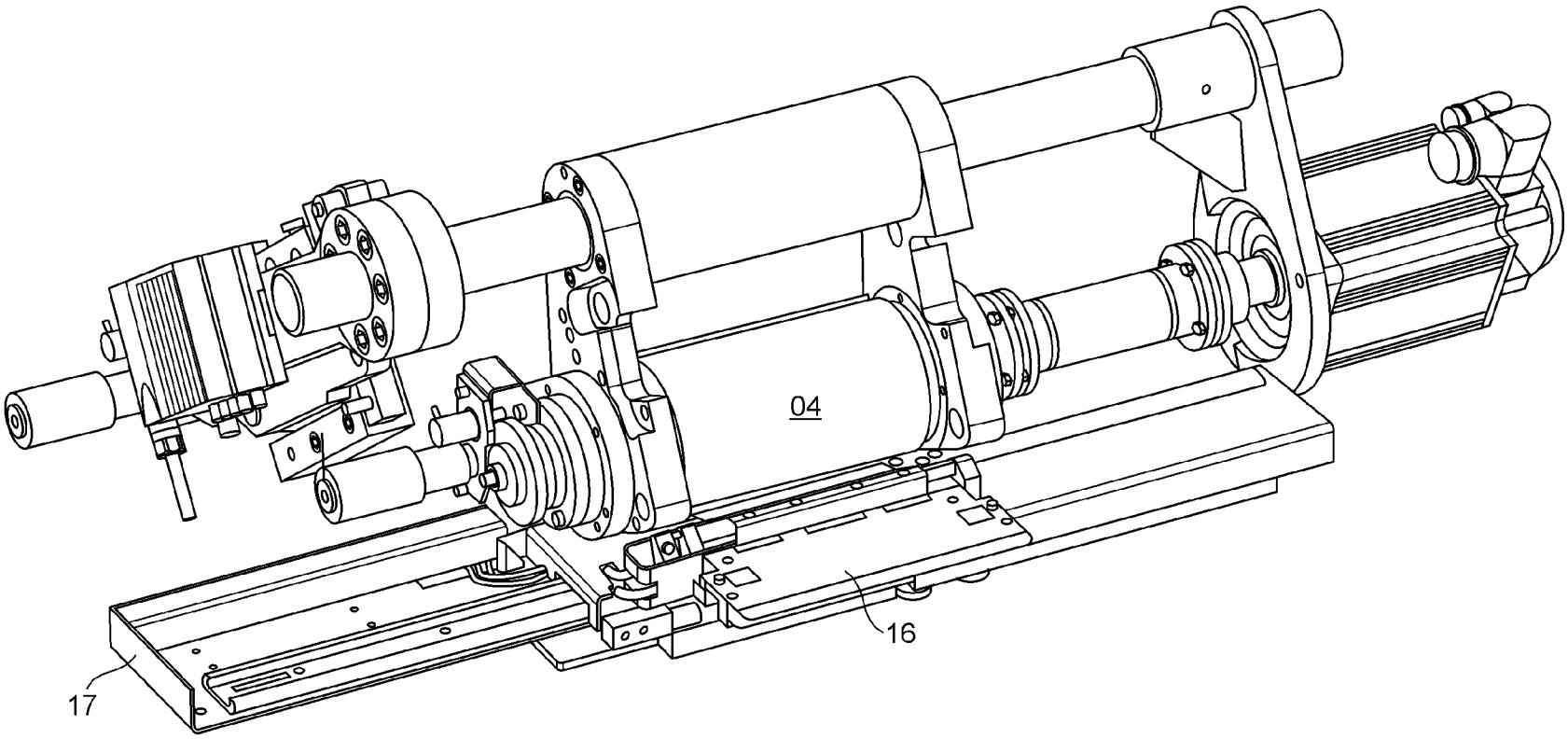
FIG. 6 shows the plate changer of FIG. 5 in a second operating position.
Figure 7:
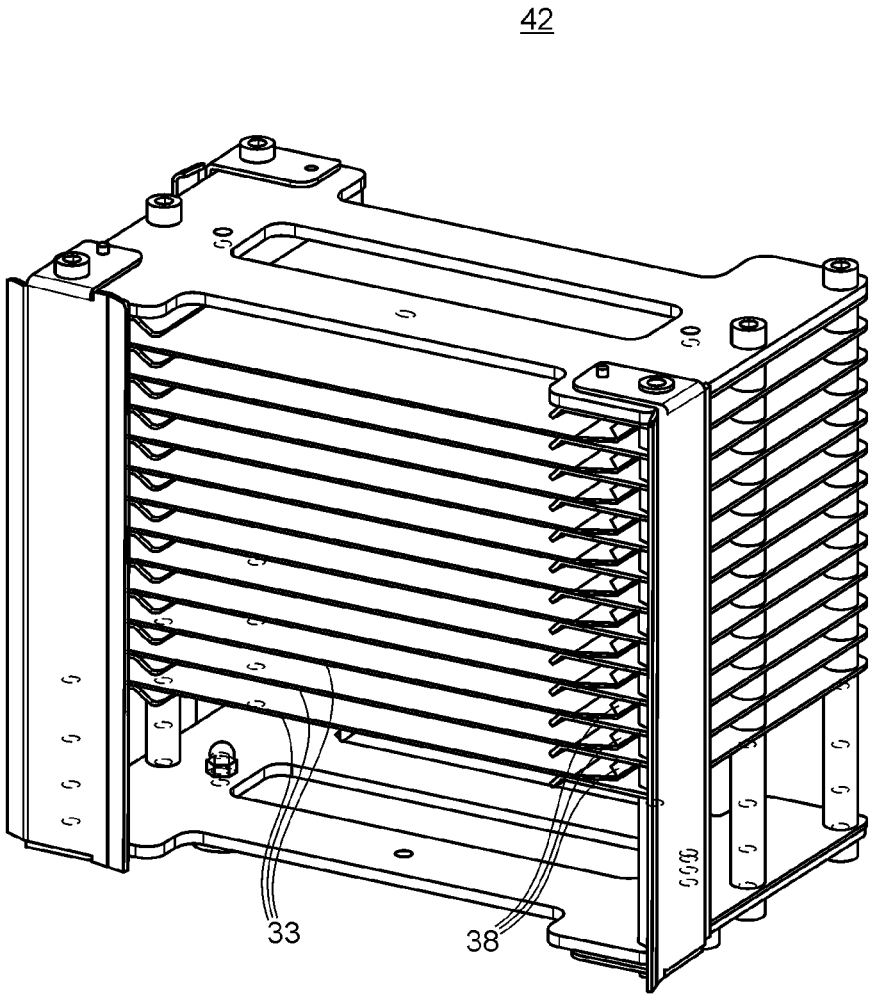
FIG. 7 shows a magazine for printing blankets.
Figure 8:
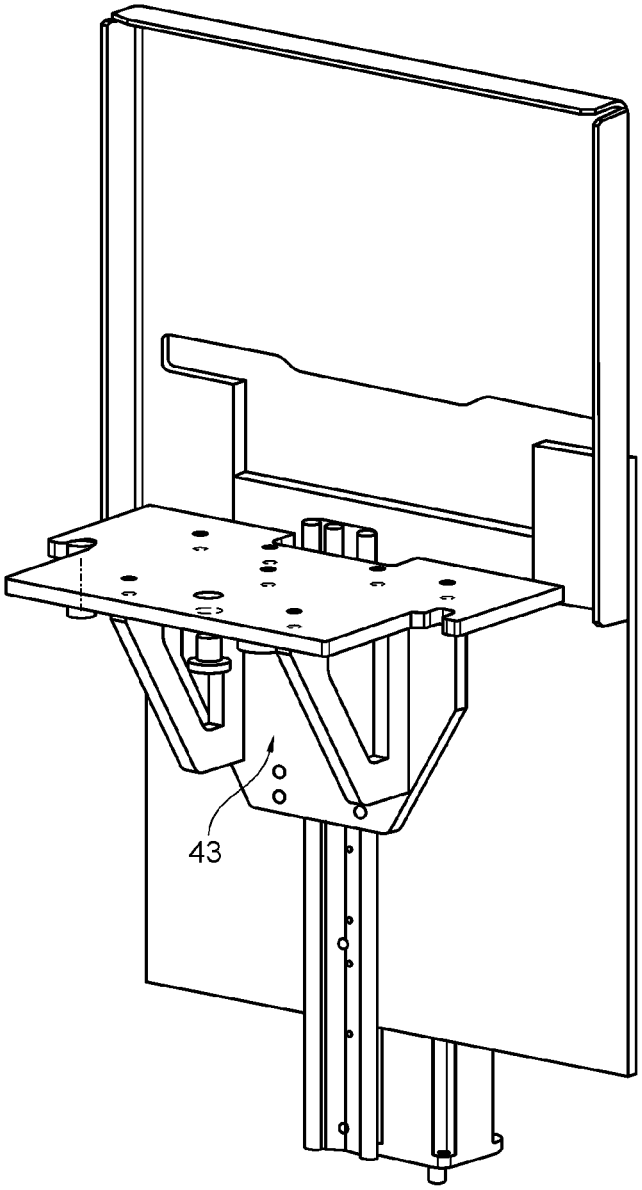
FIG. 8 shows a device for vertical transport of the magazine shown in FIG. 7.

In a highly advantageous embodiment of the device for printing on hollow bodies, a plate changer 14 is provided, e.g. for each printing forme cylinder, in particular plate cylinder 04, preferably in a fixed assignment thereto, with which plate changer the printing forme intended for the printing forme cylinder in question or the printing plate intended for the plate cylinder 04 in question can be replaced, preferably automatically, within e.g. the relevant device for printing on or decorating hollow bodies 01, each having in particular a cylindrical lateral surface. FIGS. 5 and 6 show a perspective view of a preferred embodiment of a plate changer 14 of highly advantageous configuration, in two different operating positions for performing a plate change or printing forme change that can be completed within a very short setup time, preferably automatically, reliably and preferably also while maintaining register. FIG. 5 shows a first operating position, in which, e.g. a printing plate may be brought forward on the printing forme cylinder or plate changer 14 or removed from plate changer 14, axially to the side of the printing unit. FIG. 6 shows a second operating position, in which, immediately upstream of the printing forme cylinder or plate cylinder 04 and lengthwise thereto, e.g. a printing plate may be placed from plate changer 14 directly onto the assigned plate cylinder 04, or a printing plate may be removed from plate cylinder 04 and transported away with plate changer 14 to its first operating position. Plate changer 14 has in particular a planar, e.g. table-shaped bearing surface 16, on which e.g. a printing plate that is or will be arranged on plate cylinder 04 can be supported, preferably fully. Bearing surface 16 is preferably arranged such that it is movable bidirectionally, i.e. movable back and forth, along a linear transport path, in particular longitudinally to the rotational axis of the associated printing forme cylinder or plate cylinder 04, between at least two defined positions. In a first position of bearing surface 16, located to the side of the printing unit, plate changer 14 assumes its first operating position, and in a second position of bearing surface 16, located immediately upstream of the printing forme cylinder or plate cylinder 04 and longitudinally thereto, the plate changer assumes its second position. In the first operating position, bearing surface 16 of plate changer 14 is located at least partially upstream of an end face of the printing forme cylinder or plate cylinder 04 in question. In the second operating position, bearing surface 16 of plate changer 14 is preferably at least partially beneath the lateral surface of the printing forme cylinder or plate cylinder 04. Bearing surface 16 of plate changer 14 moves, e.g. along a cross-member 17 arranged longitudinally with respect to the printing forme cylinder or plate cylinder 04. Bearing surface 16 of plate changer 14 thus has an axial travel path with respect to the printing form cylinder or plate cylinder 04 in question. At the positions that define the first and second operating positions of plate changer 14, the movement of bearing surface 16 is limited in each case, e.g. by a stop. At least the substrate of the printing plate in question is formed, e.g. by a trimming process, which is carried out in particular using register marks, such that the printing plate in question can be arranged true to register on bearing surface 16 of plate changer 14. For this purpose, at least two edges of the substrate of the printing plate in question, disposed perpendicular to one another, are brought into direct contact with stops, in particular formed by register pins, located on bearing surface 16 of plate changer 14, with a first edge of the substrate of the printing plate in question abutting against a first register pin and a second edge of the substrate of the printing plate in question, orthogonal to the first edge, abutting against a second register pin, and with the position of one of these two register pins being variable and preferably adjustable. By adjusting the variable-position register pin, e.g. the relevant printing plate can be aligned true to register. The variable-position register pin may be adjusted manually or automatically. Since the printing plate is supplied to the relevant plate cylinder 04 true to register, e.g. no centering pin or any other register device is provided is on plate cylinder 04.

In its preferred embodiment, in addition to bearing surface 16 for receiving a printing plate to be supplied, in particular true to register, e.g. to plate cylinder 04, plate changer 14 has, e.g. a compartment in which, e.g. a printing plate that has been removed from plate cylinder 04 may be placed. A printing plate held, e.g. by means of its substrate, in particular magnetically, on the lateral surface of the plate cylinder 04 in question is or at least can be lifted off of the lateral surface of the plate cylinder 04 in question, e.g. by means of a tool guided tangentially to the printing forme, e.g. by means of a spatula guided between the substrate of the printing plate and the lateral surface of the plate cylinder 04 in question. The end of a printing plate that has been lifted off of the lateral surface of the plate cylinder 04 in question is introduced by a rotation of the plate cylinder 04 in question into the appropriate compartment of plate cylinder 04. The further rotation of said plate cylinder 04 then pushes the entire printing plate detached from the lateral surface of the relevant plate cylinder 04 into the appropriate compartment of plate changer 14.

A printing plate to be supplied, preferably true to register, to the plate cylinder 04 in question is held, in particular after being aligned true to register, on bearing surface 16 of plate changer 14 by a magnetic holding force. At least one plunger, and preferably two plungers arranged spaced apart longitudinally along the plate cylinder 04 in question, is/are provided, each having a direction of action directed opposite the magnetic holding force and toward bearing surface 16 of plate changer 14, e.g. substantially orthogonal thereto; with said at least one plunger, at least one end of the printing plate held on bearing surface 16 of plate changer 14, said end facing the plate cylinder 04 in question, can be detached from said bearing surface 16 and can be transferred to the plate cylinder 04 in question by way of a stroke movement of the at least one plunger. The at least one plunger is or at least can be actuated pneumatically, for example. The printing forme or the printing plate is held on bearing surface 16 of plate changer 14 or on the lateral surface of plate cylinder 04 by means of magnets, with each of these magnets preferably being embodied as a permanent magnet. The above-described configuration of plate cylinder 04 has the advantage that no conveyor device is required for transferring the printing plate to the relevant plate cylinder 04 or for removing the printing plate from the relevant plate cylinder 04, and therefore, plate changer 14 can be realized very inexpensively. In particular, a plate change can be carried out automatically using the plate changer 14 described above.

The throwing on and/or throwing off of printing forme cylinder or plate cylinder 04, ink forme roller 07 and/or anilox roller 08 and/or the adjustment of the contact pressure exerted by each of these is carried out by means of a throw-on/throw-off mechanism, illustrated by way of example in FIGS. 2 and 3, which will now be described in detail. In the preferred embodiment, the printing forme cylinder or plate cylinder 04 is mounted, in particular at both ends, on a load arm of a first, preferably one-sided lever assembly 18, consisting of a force arm and the load arm, wherein the force arm and the load arm, which is arranged at a fixed angle relative to the force arm, of this first lever assembly 18 can be pivoted jointly about a first rotational axis 19, directed axially parallel to plate cylinder 04. A first drive 21, e.g. in the form of a hydraulic or pneumatic working cylinder and preferably controllable by a control unit, is operatively connected to the force arm of the first lever assembly 18 for the purpose of applying torque about the first rotational axis 19, wherein upon actuation of this first drive 21, the printing forme cylinder or plate cylinder 04 arranged on the load arm of this first lever assembly 18 is either thrown off of a printing blanket, e.g. of the segmented wheel 03 or thrown onto the same, depending upon the direction of action of said drive. To limit the contact pressure exerted by the printing forme cylinder or plate cylinder 04 against the printing blanket in question, e.g. of segmented wheel 03, a first stop 22 which limits the path traveled by the pivoting movement of the printing forme cylinder or plate cylinder 04 toward segmented wheel 03 is provided, for example for the force arm of the first lever assembly 18. The contact pressure exerted by the printing forme cylinder or plate cylinder 04 against segmented wheel 03 can be adjusted using the first drive 21.

In the preferred embodiment, ink forme roller 07 is also mounted, in particular at both ends, on a load arm of a preferably one-sided second lever assembly 23, consisting of a force arm and the load arm, wherein the force arm and the load arm of this second lever assembly 23 are pivotable jointly about the first rotational axis 19, which is aligned axially parallel to plate cylinder 04. Likewise in the preferred embodiment, anilox roller 08 is also mounted, in particular at both ends, on a load arm of a preferably one-sided third lever assembly 24, consisting of a force arm and the load arm, wherein the force arm and the load arm of this third lever assembly 24 are pivotable jointly about a second rotational axis 26, which is aligned axially parallel to anilox roller 08, wherein the second rotational axis 26 of the third lever assembly 24 is located on the second lever assembly 23, and wherein the second rotational axis 26 is embodied as fixed on the second lever assembly 23. On the load arm of the first lever assembly 18, a preferably controllable second drive 27 is arranged, which when actuated acts on the force arm of the second lever assembly 23, and which can be used to throw ink forme roller 07 onto or off of plate cylinder 04, depending upon the direction of action of second drive 27. On the load arm of the second lever assembly 23, a preferably controllable third drive 28 is arranged, which when actuated acts on the force arm of the third lever assembly 24, and which can be used to throw anilox roller 08, preferably together with chamber doctor blade system 09, onto or off of ink forme roller 07, depending upon the direction of action of third drive 28. The second drive 27 and/or the third drive 28 is/are each also embodied, e.g. in the form of a hydraulic or pneumatic working cylinder. It may be provided that second drive 27 and third drive 28 are or at least can be actuated, e.g. jointly and preferably also simultaneously. The pivoting movement of the load arm of the second lever assembly 23 is limited, e.g. by a first stop system 29 which is preferably adjustable, in particular by means of an eccentric, whereby the contact pressure exerted by ink forme roller 07 against the printing forme cylinder or plate cylinder 04 is or at least can be limited. The pivoting movement of the load arm of the third lever assembly 24 is limited, e.g. by a second stop system 31 which is preferably adjustable, in particular by means of an eccentric, whereby the contact pressure exerted by anilox roller 08 against ink forme roller 07 also is or at least can be limited. FIG. 2 shows a first operating state, by way of example, in which the first drive 21 and the second drive 27 and the third drive 28 are not activated, or each is in its idle state, in which anilox roller 08 is thrown onto ink forme roller 07, and ink forme roller 07 is thrown onto the printing forme cylinder or plate cylinder 04, and the printing forme cylinder or plate cylinder 04 is thrown onto segmented wheel 03. FIG. 3 shows a second operating state, by way of example, in which the first drive 21 and the second drive 27 and the third drive 28 are activated, or each is in its working state, in which anilox roller 08 is thrown off of ink forme roller 07, and ink forme roller 07 is thrown off of the printing forme cylinder or plate cylinder 04, and the printing forme cylinder or plate cylinder 04 is thrown off of segmented wheel 03. The force arm and/or load arm of each of the three aforementioned lever assemblies 18; 23; 24 is or are each embodied, e.g. as a pair of opposing lever rods or side frame walls, between which either the printing forme cylinder or plate cylinder 04 or the ink forme roller 07 or the anilox roller 08 is arranged, each in its respective assignment as described above. Each of the three aforementioned lever assemblies 18; 23; 24 is arranged in a different vertical plane, spaced apart from the others, so that none of the lever assemblies can impede the pivoting of the others.

As described above and as shown in FIG. 13, typically a plurality of printing blankets 33, e.g. eight to twelve, are arranged one behind the other on the periphery of segmented wheel 03, and during the printing process, as this segmented wheel 03 rotates about a rotational axis 34, printing formes of the printing forme cylinder or printing plates of plate cylinder 04 roll along the printing blankets 33 that are moved by said segmented wheel 03. During rolling, each of the printing plates presses at least its print relief, e.g. 0.2 mm to 0.25 mm deep into the respective printing blanket 33, thereby subjecting the printing blankets to wear and tear, as a result of which, depending upon their condition and, in particular, their mechanical stress, the printing blankets may need to be replaced after a certain number of prints, e.g. after 50,000 hollow bodies 01 have been printed. When a device for printing on or decorating hollow bodies 01, i.e. known as a decorator, having this type of segmented wheel 03 is used in a large-scale production operation to produce, e.g. several hundred or even a few thousand such hollow bodies 01 per minute, e.g. between 1,500 and 3,000 pieces per minute, the printing blankets 33 arranged on the periphery of the segmented wheel 03 need to be replaced quite frequently, in some cases every half hour or about every forty-five minutes. To keep the productivity of such a device for printing on or decorating hollow bodies 01 high, a solution for performing the necessary replacement of the printing blankets 33 arranged on the periphery of segmented wheel 03 with the shortest possible setup time is sought.

Figure 13:
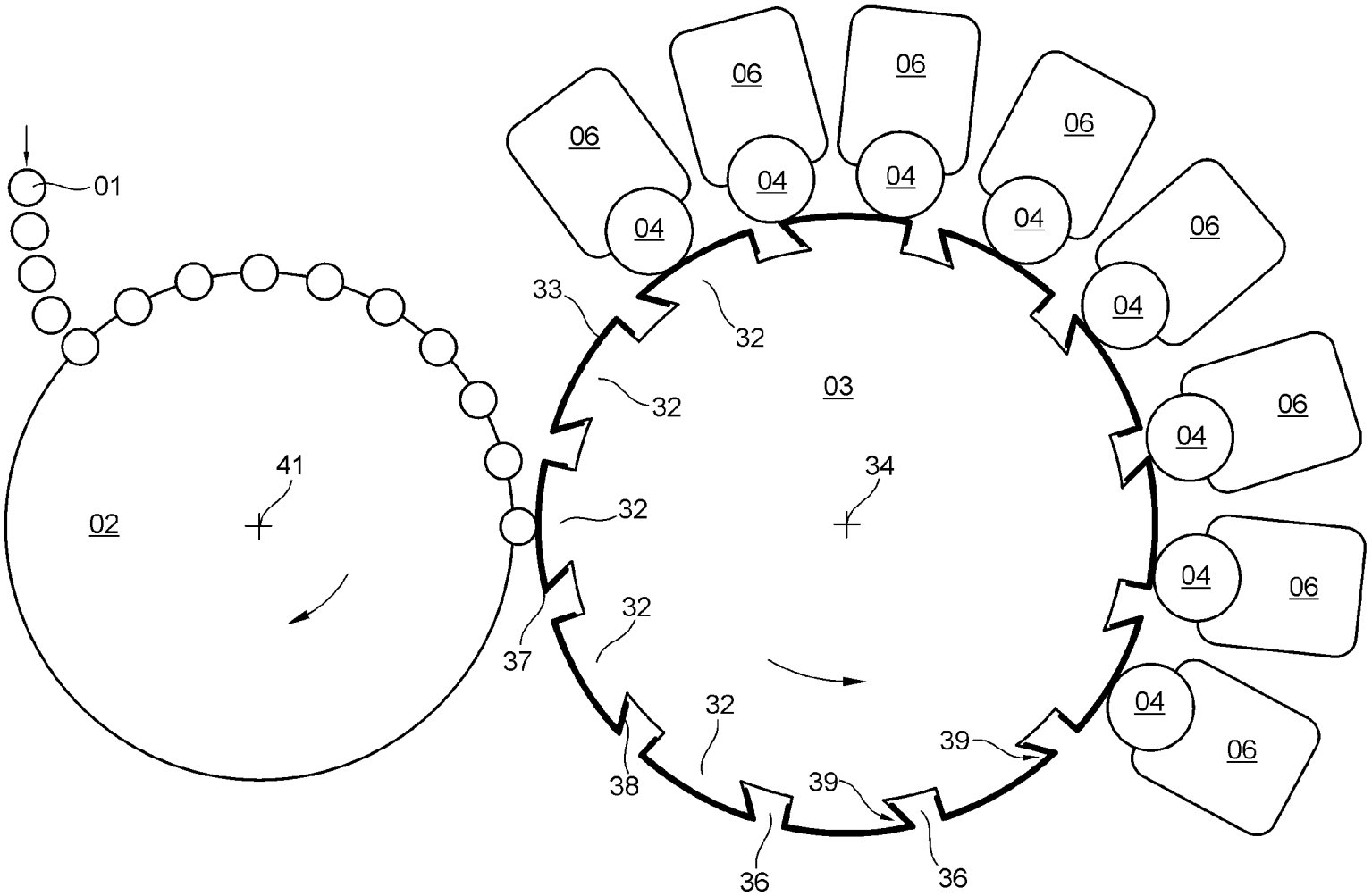
FIG. 13 shows the device of FIG. 1 for printing on or decorating hollow bodies, each of which has a lateral surface, with a schematic representation of the segments of the segmented wheel.

It is therefore proposed to provide a device, assigned to segmented wheel 03, for automatically changing the printing blankets 33. In the preferred embodiment, each of these printing blankets 33 to be arranged on segmented wheel 03 is applied adhesively, in particular by gluing, to a preferably flat, tabular metal substrate having a material thickness of, e.g. 0.2 mm. Each preferably magnetizable metal substrate is then arranged, together with the printing blanket 33 disposed thereon, in particular in the proper position, on one of the segments 32 on the periphery of segmented wheel 03, e.g. by means of at least one of the holding magnets 81 provided there on the periphery for each blanket 33 or the substrate thereof. To support the arrangement of each metal substrate in the proper position on the appropriate segment 32 on the periphery of segmented wheel 03, an acutely angled mounting arm 38 is provided, e.g. at the leading edge 37 of the respective metal substrate in the direction of rotation of segmented wheel 03, and when the respective metal substrate is arranged on one of the segments 32 on the periphery of segmented wheel 03, this mounting arm 38 engages into a recess 36 formed on the periphery of this segmented wheel 03, aligned parallel to the rotational axis 34 thereof and embodied, e.g. as a groove, and comes to rest, in particular in a form-fitting connection, on a leading edge 39 of the recess 36 in question in the direction of rotation of segmented wheel 03. Each of the printing blankets 33 is preferably embodied as a rubber blanket. The direction of rotation of segmented wheel 03 during the printing process is indicated in FIG. 13 by a rotational arrow. During the printing process, hollow bodies 01, each of which is moved on a clamping mandrel by the mandrel wheel 02, which rotates about rotational axis 41, up to segmented wheel 03, are pressed by a predominantly radial movement of the clamping mandrel concerned individually and briefly in succession, i.e. typically for a single revolution of hollow body 01 to be printed, against the printing blanket 33 currently printing.

Figure 9:
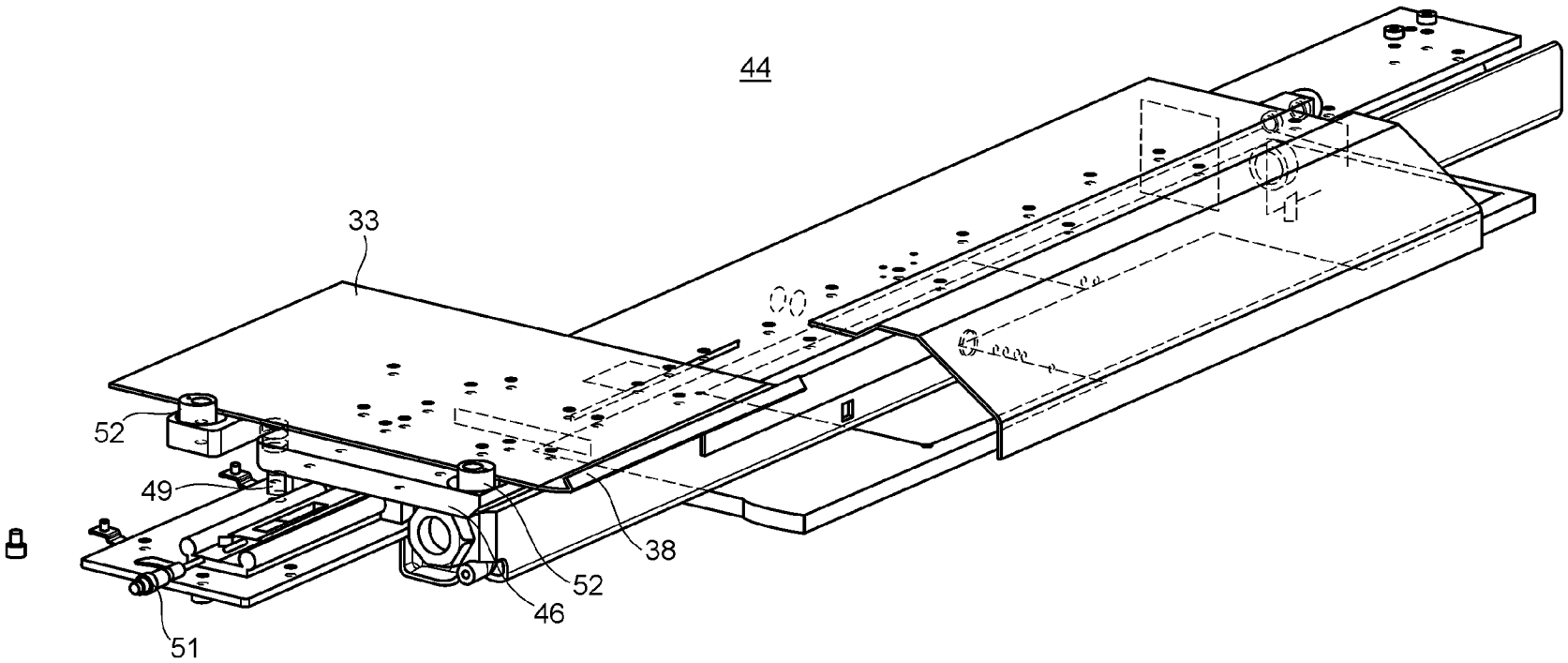
FIG. 9 shows a device for the horizontal transport of one of the printing blankets at a time, between the magazine shown in FIG. 7 and a mounting position on a segmented wheel in the device shown in FIG. 1.
Figure 10:
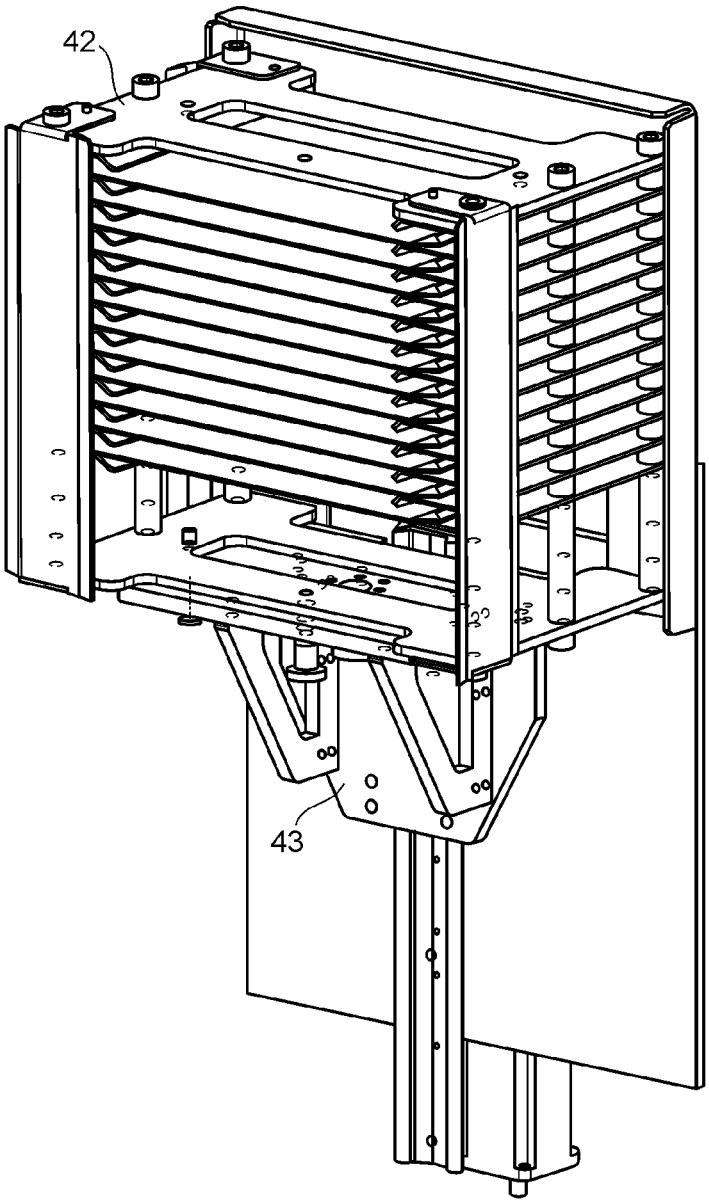
FIG. 10 shows the magazine of FIG. 7 in its operating state disposed on the device provided for its vertical transport.
Figure 11:
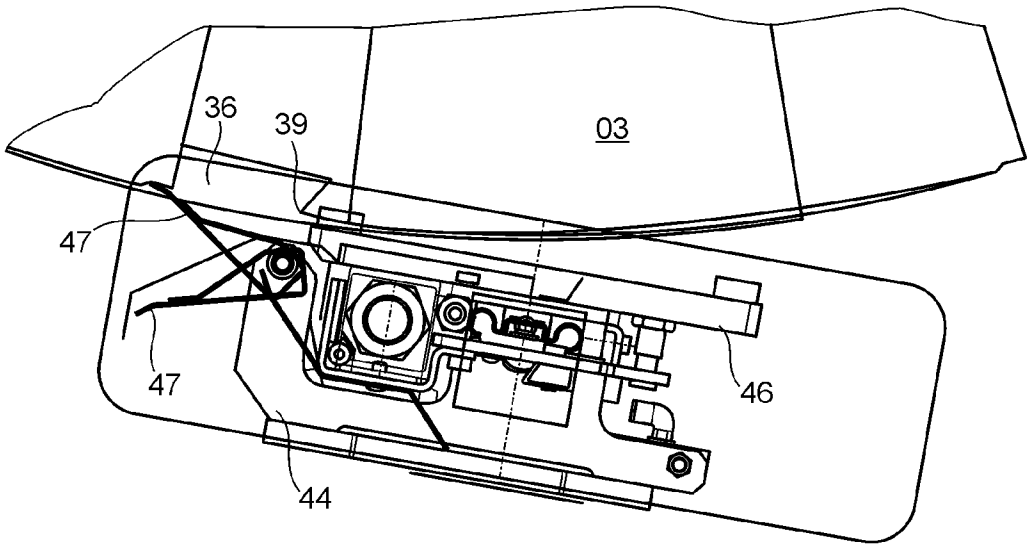
FIG. 11 shows a cross-sectional view of the device for horizontal transport of one of the printing blankets at a time, as shown in FIG. 9, with a deployed spatula for removing a used printing blanket from the segmented wheel.
Figure 12:
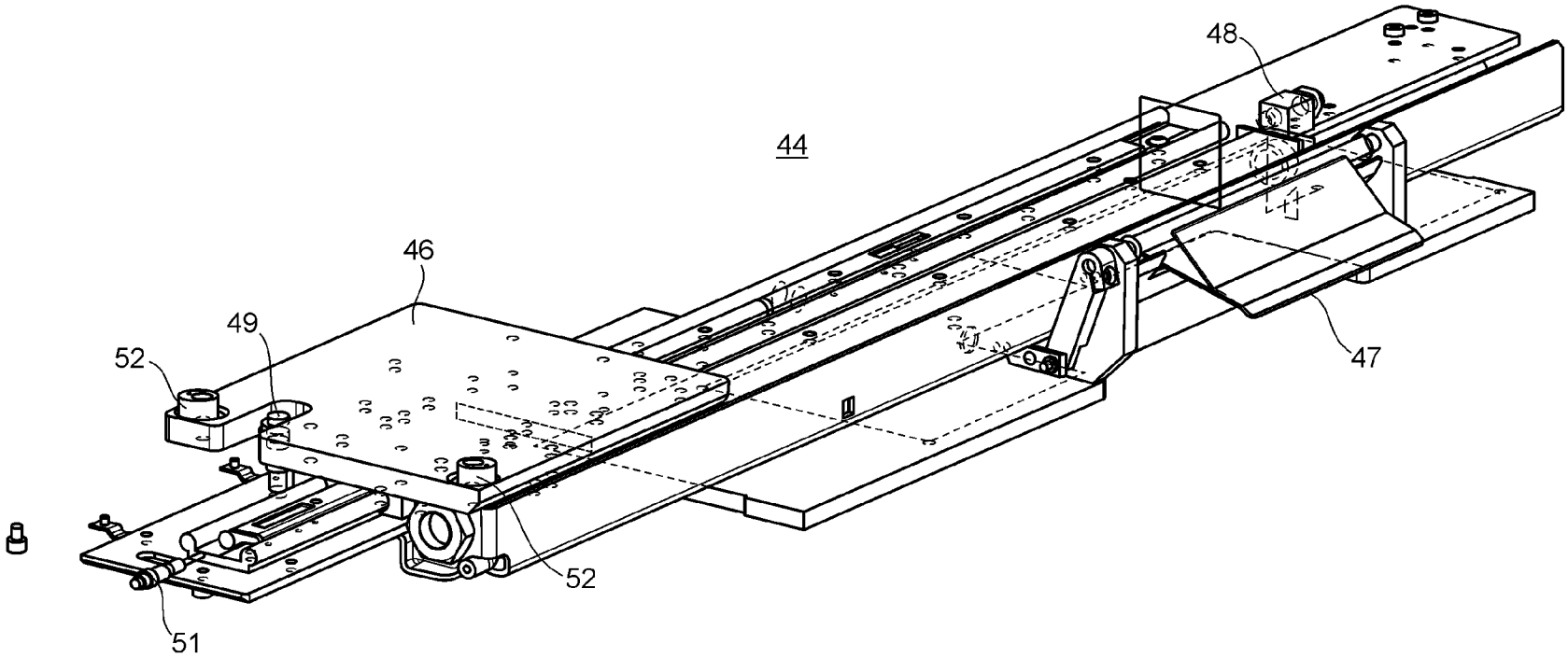
FIG. 12 shows a perspective view of the device for horizontal transport of one of the printing blankets at a time, as shown in FIG. 9, with the deployed spatula.

The device for automatically changing the printing blankets 33 is preferably modular in construction and includes as modules—as shown by way of example in FIGS. 7 to 12—e.g. a magazine 42 for a plurality of printing blankets 33, e.g. up to twelve (FIG. 7), along with a device 43 for vertical transport of the aforesaid magazine 42 (FIG. 8) and a device 44 for transporting one of printing blankets 33 horizontally between magazine 42 and a mounting position on segmented wheel 03 (FIG. 9). FIG. 10 shows the magazine 42 in its operating state located on the device 43 provided for its vertical transport. Magazine 42 includes, in a preferably cuboid housing, a plurality of compartments stacked vertically, in each of which a single printing blanket 33 is or at least can be stored on its back, i.e. lying on its substrate, preferably in a horizontal alignment, wherein in the housing, e.g. at least as many compartments are provided as the number of segments 32 for printing blankets 33 located on the periphery of the assigned segmented wheel 03. Each of the compartments is open, e.g. on at least one of its longitudinal sides, to enable a respective printing blanket 33 to be inserted into or removed from the open side of the respective compartment. This magazine 42 preferably is or at least can be mounted, as a module that can be easily replaced, e.g. without the use of tools, on or at a support of the device 43 for vertical transport of said magazine 42. The device 43 for the vertical transport of magazine 42 is configured to carry out, e.g. a lifting movement, with the vertical travel path measuring, e.g. about 200 mm. The lifting movement of the device 43 for vertical transport of magazine 42 is carried out, e.g. by means of a trapezoidal threaded spindle, preferably driven by an electric motor. To transport the individual printing blankets 33 between magazine 42 and a mounting position on a segment 32 of segmented wheel 03, a device 44 for transporting these printing blankets 33 horizontally is provided. This device 44 for transporting printing blankets 33 horizontally has, e.g. a carriage 46 that is movable bidirectionally, in particular linearly, between two end points, with carriage 46 transporting or at least being capable of transporting a single printing blanket 33 at a time. A printing blanket 33 removed automatically from magazine 42 is transported on carriage 46, preferably lying on its back, to a mounting position, e.g. located beneath segmented wheel 03, where it is received by a segment 32 of segmented wheel 03. A printing blanket 33 to be removed from a segment 32 of segmented wheel 03 is preferably peeled off of the segment 32 in question by means of a spatula 47 which is or at least can be set against the segment 32 in question, and is transported, e.g. lying on carriage 46, from its removal position on the periphery of segmented wheel 03 to magazine 42, wherein in the preferred embodiment, the spatula 47, which is set at an acute angle or tangentially against the segment 32 in question of segmented wheel 03, combined with a rotational movement of segmented wheel 03 directed toward the spatula 47, lifts the metal substrate of the printing blanket 33 in question, held in particular magnetically on the periphery of segmented wheel 03, off of the segment 32 in question, and thus off of the periphery of said segmented wheel 03. In FIG. 11, spatula 47 is shown in both an operating position in which it is set against the relevant segment 32 of segmented wheel 03, and in a parked operating position, these operating positions being occupied alternately.

The replacement or changing of at least one of the printing blankets 33 arranged on the periphery of segmented wheel 03 is then preferably carried out as follows:

Segmented wheel 03 conveys, by means of its rotation, a printing blanket 33 which is arranged on the periphery of said wheel and is to be removed, into a position at which a removal of said printing blanket 33 can be carried out by means of the device for automatically changing the printing blankets 33. Carriage 46 of the device 44 for transporting printing blankets 33 horizontally travels along its travel path up to the end point which is closest to the removal point of the printing blanket 33 to be removed. This position of carriage 46 is preferably monitored by sensory elements and/or by a first switching element 48, e.g. by means of an inductive or capacitive proximity switch. Spatula 47 is then preferably set against the trailing edge 37, in the direction of rotation of segmented wheel 03, of the metal substrate of the relevant printing blanket 33 to be removed. By rotating segmented wheel 03 at least briefly in the direction opposite its direction of rotation used during the printing process, the printing blanket 33 to be removed, which is preferably held magnetically on the periphery of segmented wheel 03, is peeled off of the periphery of said segmented wheel 03, i.e. the metal substrate of printing blanket 33 is lifted away from its position resting on segmented wheel 03. Spatula 47 is then moved away from the periphery of segmented wheel 03. The printing blanket 33 that has been detached from the relevant segment 32 of segmented wheel 03 then either drops by virtue of gravity directly into a magazine for worn printing blankets 33 or is transported to said magazine for worn printing blankets by means of carriage 46 of the device 44 for transporting printing blankets 33 horizontally.

A new printing blanket 33 glued to a metal substrate is loaded in at least one compartment, preferably in each of the compartments of the magazine 42 provided for a plurality of new printing blankets 33, and said magazine 42 is preferably located in a raised upper position by means of the device 43 for vertical transport thereof. The carriage 46 of the device 44 for horizontally transporting one printing blanket 33 at a time between magazine 42 and the mounting position on segmented wheel 03 is situated beneath the compartment that contains the new printing blanket 33. The device 43 for vertical transport lowers this magazine 42, thereby placing the new printing blanket 33 onto carriage 46 of the device 44 for horizontal transport. The process is monitored, preferably by sensory means and/or by a second switching element 49, e.g. by means of an inductive or capacitive proximity switch, to determine whether the new printing blanket 33 has actually been placed on carriage 46 of the device 44 for horizontal transport. If not, an error message is issued. Otherwise, i.e. if no error is detected, carriage 46 of the device 44 for transporting printing blankets 33 horizontally moves along its travel path up to the end point closest to the mounting position for the new printing blanket 33, with this position of carriage 46 in turn being monitored, preferably by sensory means and/or by a third switching element 51, e.g. by means of an inductive or capacitive proximity switch. Segmented wheel 03 is also already located in a rotational angle position suitable for receiving the new printing blanket 33, with this rotational angle position being located, e.g. at or near the bottom of segmented wheel 03. In the preferred embodiment, the position of the new printing blanket 33 is aligned at least true to register by said printing blanket abutting against at least stop 52, before being mounted on the periphery of segmented wheel 03. For moving carriage 46 of the device 44 for transporting printing blankets 33 horizontally, a drive is provided, said drive being embodied, e.g. as a compressed air cylinder. To mount the new printing blanket 33 on the periphery of segmented wheel 03, said segmented wheel 03 rotates in the direction of rotation used during the printing process, thereby drawing the new printing blanket 33 up onto its periphery. Carriage 46 of the device 44 for transporting printing blankets 33 horizontally is then moved back to the magazine 42 for the plurality of new printing blankets 33, to retrieve another new printing blanket 33, if necessary.

To reduce setup times, it is advantageous to configure a device for printing on hollow bodies 01 such that said device includes a segmented wheel 03 which is rotatable about a rotational axis 34, wherein segmented wheel 03 has a plurality of segments 32 in a row along its periphery, each for receiving one printing blanket 33, wherein at least one of the printing blankets 33 located on one of the segments 32 is arranged to roll or at least to be capable of rolling along the hollow body 01 to be printed on, wherein a plurality of printing units are provided, wherein at least one of the printing units is or at least can be thrown onto at least one of the printing blankets 33 arranged on the periphery of segmented wheel 03, wherein at least one of the printing units includes a printing forme cylinder 04, wherein in association with the relevant printing forme cylinder 04, a plate changer 14 for automatically changing a printing forme is located on said printing forme cylinder 04, and wherein in association with segmented wheel 03, a device for automatically changing at least one of the printing blankets 33 arranged on the periphery of said segmented wheel 03 is provided. Said plate changer 14 preferably has a bearing surface 16, onto which the printing forme that is or will be arranged on printing forme cylinder 04 can be placed, said bearing surface 16 being movable bidirectionally along a transport path between at least two defined positions. The printing forme to be supplied to the printing forme cylinder 04 in question is held, e.g. by a magnetic holding force on the bearing surface 16 of plate changer 14. The device for automatically changing the printing blankets 33 is modular, in particular, and includes as modules a magazine 42 for a plurality of printing blankets 33, along with a device 43 for vertically transporting said magazine 42, and a device 44 for horizontally transporting one of the printing blankets 33 at a time between magazine 42 and one of the segments 32 of segmented wheel 03. Magazine 42 has a plurality of vertically stacked compartments, in each of which a single printing blanket 33 is or at least can be stored, within a housing. Each of the printing blankets 33 is preferably stored lying on its back and/or in a horizontal alignment in magazine 42. Device 43 for vertically transporting magazine 42 is configured to execute, e.g. a lifting movement, and/or device 44 for transporting printing blankets 33 horizontally has a carriage 46 which is movable bidirectionally between two endpoints, wherein a single printing blanket 33 is or at least can be transported at a time by carriage 46. Plate changer 14 and the device for automatically changing the printing blankets 33 are each controlled, e.g. by a control unit, wherein plate changer 14 and the device for automatically changing printing blankets 33 are active in particular at the same time, and each carries out its changing of a printing plate or a printing blanket 33, e.g. during the same interruption in the production process being run on this device for printing on hollow bodies 01. The printing forme to be arranged on printing forme cylinder 04 is preferably arranged on bearing surface 16 of plate changer 14 true to register with respect to its mounting position on printing forme cylinder 04, and/or the printing blanket 33 to be arranged on the periphery of segmented wheel 03 is arranged on the carriage 46 of the device 44 for transporting printing blankets 33 horizontally in the correct position with respect to its mounting position on a segment 32 of segmented wheel 03. An inking unit 06 for transporting printing ink to printing forme cylinder 04 is preferably embodied as a short inking unit that includes an anilox roller 08.

With respect to a device for printing on hollow bodies 01, which includes a segmented wheel 03 that is rotatable about a rotational axis 34, wherein the segmented wheel 03 has a plurality of segments 32 in a row along its periphery, each for receiving a printing blanket 33, wherein at least one of the printing blankets 33 arranged on one of the segments 32 is arranged rolling or at least capable of rolling along the hollow body 01 to be printed, wherein every two adjacent segments 32 are separated from one another by a recess 36 aligned parallel to the rotational axis 34 of segmented wheel 03, it is also advantageous for each of the printing blankets 33 to be disposed on a plate-shaped metallic substrate, wherein the substrate along with the printing blanket 33 disposed thereon is or at least can be arranged as such, and replaceable in its entirety, on one of the segments 32 of segmented wheel 03, wherein the substrate arranged on one of the segments 32 of segmented wheel 03 is held on this segment 32 in a form-fitting and/or in a force-fitting connection. Each substrate of a printing blanket 33 is bent, preferably at an acute angle, at its leading edge 37 in the direction of rotation of segmented wheel 03, wherein when said substrate is located in the operating position on a segment 32 of segmented wheel 03, this bent edge 38 is placed at a leading edge 39, in the direction of rotation of segmented wheel 03, of the appropriate recess 36 formed on the periphery of segmented wheel 03, wherein the bent edge 38 of the substrate is or at least can be arranged in a form-fitting connection on this edge 39 of recess 36. The plate-shaped metallic substrate is embodied in particular as flexible, and together with the printing blanket 33 arranged on it forms, e.g. a metal printing blanket. The substrate arranged on one of the segments 32 of segmented wheel 03 is held on this segment 32 by a magnetic force. Eight to twelve segments 32, for example, each for receiving one printing blanket 33, are arranged in a row with preferably equidistant spacing along the periphery of segmented wheel 03. Assigned to segmented wheel 03, e.g. a device for automatically changing printing blankets 33 is provided, wherein the device for automatically changing printing blankets 33 is preferably modular in construction, and includes as modules a magazine 42 for a plurality of printing blankets 33 along with a device 43 for vertical transport of the aforementioned magazine 42 and a device 44 for horizontal transport of one of the printing blankets 33 at a time between magazine 42 and one of the segments 32 of segmented wheel 03. Magazine 42 has in particular a plurality of compartments stacked vertically within a housing, in each of which a single printing blanket 33 is or at least can be stored. The housing of magazine 42 contains e.g. at least as many compartments as the number of segments 32 for printing blankets 33 on the periphery of the associated segmented wheel 03. In the preferred embodiment, the device 43 for vertically transporting magazine 42 is configured to execute a lifting movement, and/or device 44 for transporting printing blankets 33 horizontally has a carriage 46 which is movable bidirectionally between two endpoints, wherein a single printing blanket 33 is or at least can be transported at a time by carriage 46.

This also results in a method for operating a device for printing on hollow bodies 01 which has a segmented wheel 03, wherein a printing blanket 33 is arranged on at least one segment 32 of the segmented wheel 03, which has a plurality of segments 32 one behind the other on its periphery, wherein when the segmented wheel 03 rotates, at least one printing blanket 33 arranged on one of the segments 32 rolls along the hollow body 01 to be printed on, wherein a device for automatically changing printing blankets 33, assigned to segmented wheel 03, in response to a command issued to its control unit, automatically removes the printing blanket 33 to be arranged on the relevant segment 32 of the segmented wheel 03 from a magazine 42, and transports it to the segment 32 in question of segmented wheel 03. The device for automatically changing printing blankets 33 has a device 44 for horizontally transporting printing blankets 33, with a movable carriage 46, wherein each of the printing blankets 33 to be transported is transported lying on carriage 46. A printing blanket 33 lying on carriage 46 is preferably arranged in the proper position with respect to a mounting position on one of the segments 32 of segmented wheel 03. A plurality of printing blankets 33 in particular are stored in magazine 42, and these printing blankets 33 are placed individually, one after the other, on carriage 46 of the device 44 for transporting printing blankets 33 horizontally, and are transported in succession to one of the segments 32 of segmented wheel 03. A printing blanket 33 to be arranged on one of the segments 32 of segmented wheel 03 is arranged on the segment 32 in question, in particular by means of a form-fitting connection produced between the relevant segment 32 and the printing blanket 33 by a rotation of this segmented wheel 03. A printing blanket 33 arranged on one of the segments 32 of segmented wheel 03 is preferably held on the segment 32 in question, e.g. by a magnetic force connection. A printing blanket 33 that has been removed from one of the segments 32 of segmented wheel 03 is likewise preferably transported away from the segmented wheel 03 in question by the device 44 for transporting printing blankets 33 horizontally. It is preferably provided that the device 44 for transporting printing blankets 33 horizontally alternatingly transports a printing blanket 33 that has been removed from one of the segments 32 of segmented wheel 03 away, and transports a new, i.e. unused printing blanket 33 from magazine 42 to an unoccupied segment 32 of segmented wheel 03, i.e. to a segment 32 on which no printing blanket 33 is currently arranged. A switching element 49 monitors the process, e.g. to determine whether a printing blanket 33 removed or to be removed from magazine 42 has actually been placed on carriage 46 of the device 44 for horizontal transport, and/or whether it has been placed in the proper position.

FIG. 14 again shows a perspective view of segmented wheel 03 of the device for printing on hollow bodies 01, in which a plurality of segments 32, e.g. twelve segments, each for accommodating one printing blanket 33, are arranged in a row along the periphery of said segmented wheel 03. This segmented wheel 03 is preferably made of a casting material, e.g., cast iron, and weighs more than 500 kg, in particular approximately 1,000 kg or more. Segmented wheel 03 has an outer diameter ranging from 1,400 mm to 1,600 mm, for example. Segmented wheel 03 is mounted on its shaft 53 in a frame 66 of this device for printing on hollow bodies 01, preferably at both ends of said shaft, e.g. each end being mounted in particular in double-row roller bearings 63, and the rotation of the segmented wheel is driven by a drive. Said drive for driving the rotation of segmented wheel 03 is configured as an electric motor 58 having a stator 61 and a rotor 62 with a hollow shaft 54, wherein the hollow shaft 54 is or at least can be arranged coaxially with shaft 53 of segmented wheel 03. In the condition in which it is disposed in the device for printing on hollow bodies 01—as shown in the sectional view of FIG. 16—shaft 53 of segmented wheel 03 projects into the installation space of motor 58, and shaft 53 of segmented wheel 03 and rotor 62 of motor 58 are connected rigidly to one another. Segmented wheel 03 is preferably connected rigidly to its shaft 53 at both ends, e.g. by means of clamping elements 67, and is thereby secured to shaft 53. The motor 58 provided for driving the rotation of segmented wheel 03 is preferably configured as a high-pole electrical direct drive having a number of poles e.g. greater than twenty and/or is configured as a permanently energized brushless DC motor and is illustrated perspectively by way of example in FIG. 15. Said motor 58 has, e.g., a cooling device or is at least connected to such a device, said cooling device being configured as a liquid cooling system. FIG. 15 shows two ports for this liquid cooling system, formed on housing 59 of motor 58, specifically one port for coolant inflow 56 and another port for coolant outflow 57. In an advantageous embodiment, this motor 58 is configured as a torque motor. A preferably digital control unit for controlling or regulating said motor 58 is provided, wherein the control unit adjusts or at least is capable of adjusting a position on the periphery of this segmented wheel 03 relative to a position on the lateral surface of a hollow body 01 to be printed, preferably with a positioning accuracy of less than 0.1 mm, by positioning shaft 53 of segmented wheel 03 in the stator of motor 58. Likewise provided, e.g. on the end of shaft 53 opposite motor 58, is a rotary encoder 64, wherein said rotary encoder 64 has a high angular resolution, e.g. of 27 bits, and detects an angular position of shaft 53 of segmented wheel 03 and provides a measured value that corresponds to the angular position of shaft 53 of segmented wheel 03 to the control unit that controls or regulates motor 58. Motor 58 and/or the rotary encoder are preferably each connected via a control bus to the control unit that controls or regulates motor 58.

The aforementioned embodiment of the rotary drive of segmented wheel 03 has the advantage that said drive is configured as decentralized as well as gearless and clutchless. This drive of segmented wheel 03 is therefore backlash-free and compact. In conjunction with the control unit of said drive, a position on the periphery of said segmented wheel 03 relative to a position on the lateral surface of a hollow body 01 to be printed can be adjusted easily with a positioning accuracy of less than 0.1 mm, which has a very beneficial effect on the achievable print quality. In conjunction with the double-row bearing of segmented wheel 03, a highly precise concentricity of said segmented wheel 03 likewise results, thereby ensuring a uniform transfer of ink from the respective inking units 06 to the relevant printing blankets 33 arranged on the periphery of segmented wheel 03. With the solution described here, a high acceleration and thus short run-up times of 10 seconds or less can also be realized for segmented wheel 03. Furthermore, the proposed drive for segmented wheel 03 has the advantage of being low-noise and low-maintenance. Overall, this results in a highly efficient drive for segmented wheel 03.

Figure 14:
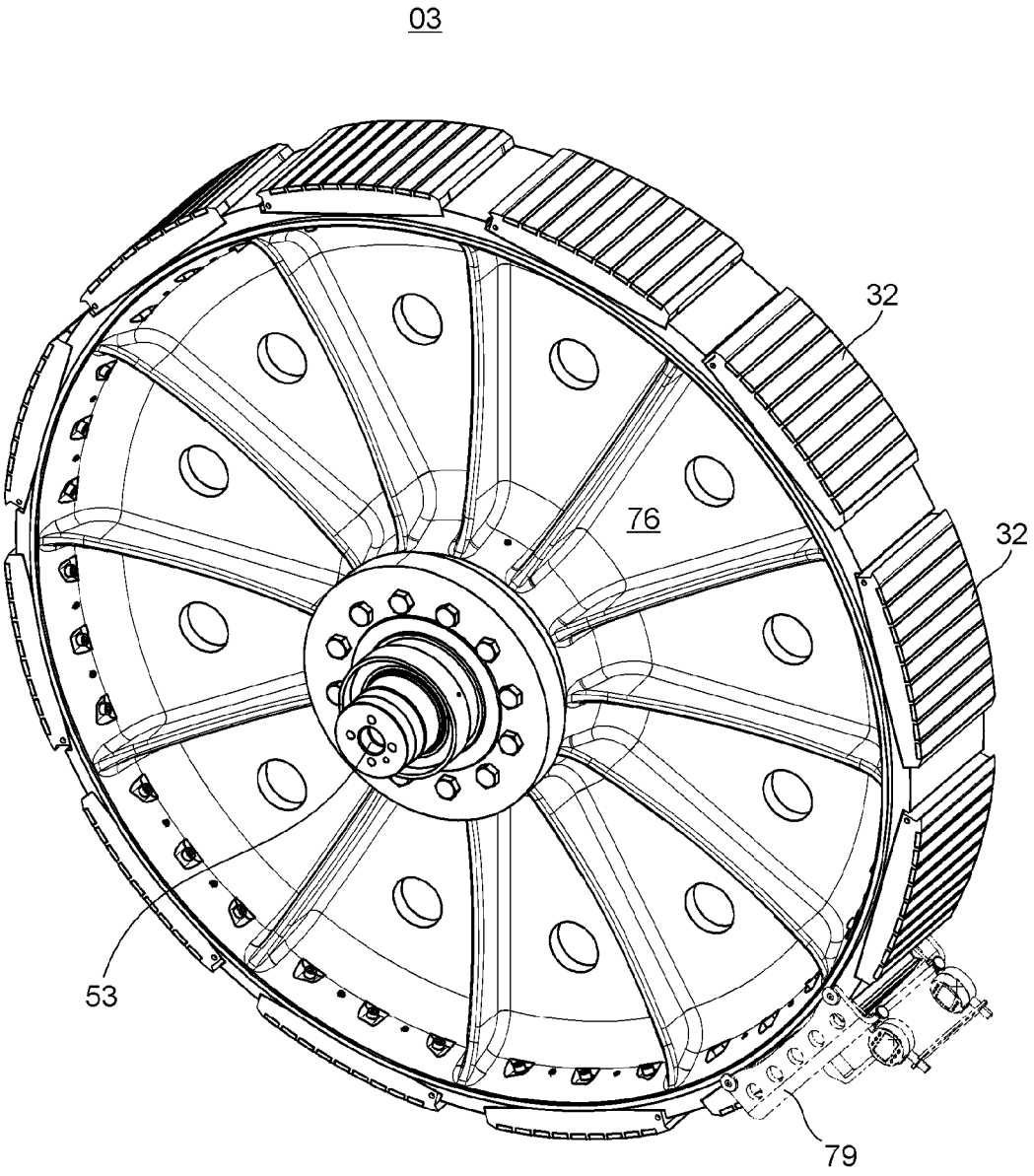
FIG. 14 shows a perspective, detailed representation of the segmented wheel along with its shaft.
Figure 15:
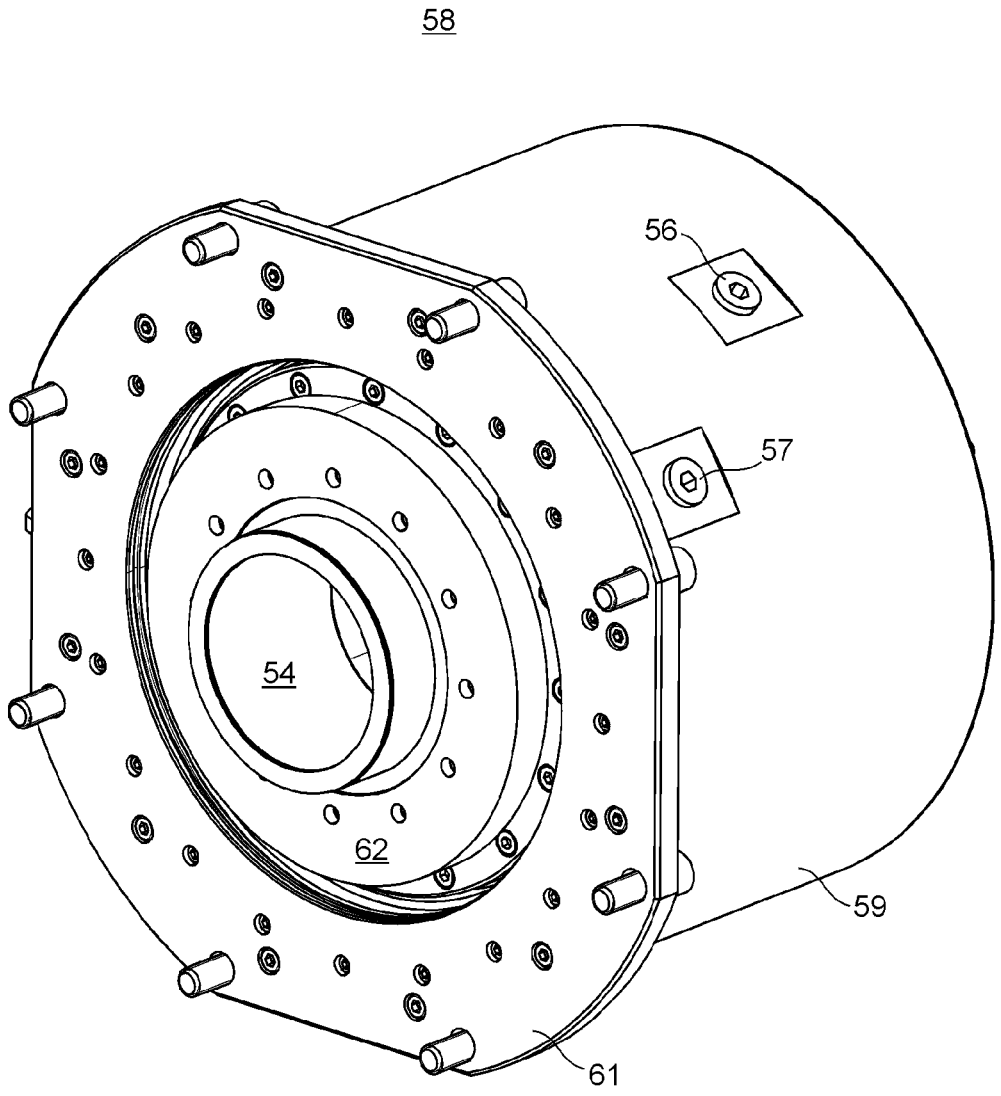
FIG. 15 shows a perspective, detailed representation of the drive for driving the rotation of the segmented wheel.
Figure 16:
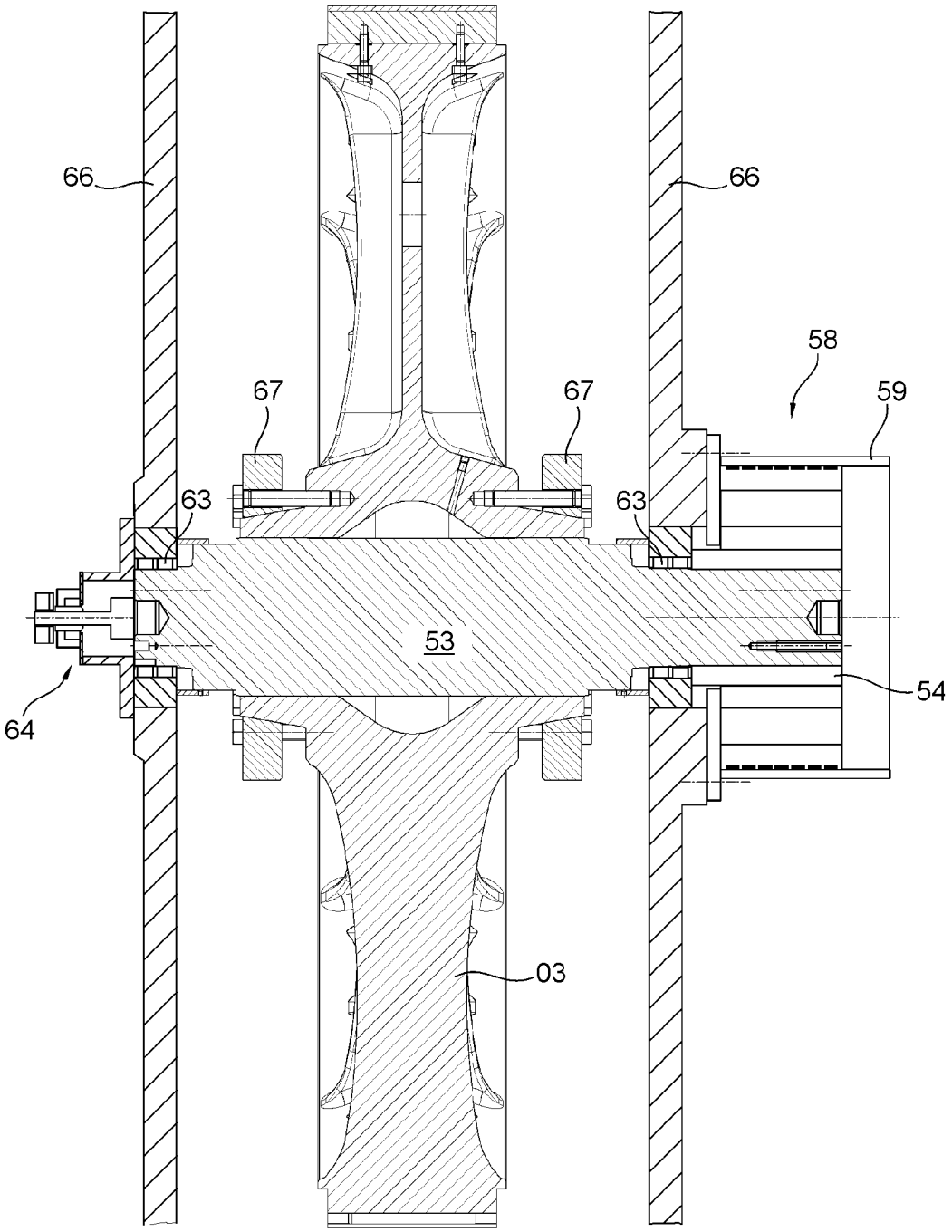
FIG. 16 shows a sectional view of the segmented wheel with its drive, in the condition as arranged in the device for printing on hollow bodies.

FIG. 19 again shows the segmented wheel 03 already described in conjunction with FIGS. 14 and 16, but here in a particularly advantageous embodiment. Segmented wheel 03, which during the printing process is mounted in frame 66 of the device for printing on hollow bodies, has a main body 76 preferably produced from a metallic material, e.g., from a welded structure or from cast iron, with a plurality of segments 32, e.g. twelve, being arranged or at least arrangeable, in particular spaced from one another, along the periphery of main body 76, each at a joint 77. Segmented wheel 03 therefore is not configured as a single integral part on which segments 32 are already molded, rather each of these segments 32 represents a separate machine element that can be separated from main body 76 and is arranged changeably on main body 76. Each of these segments 32 is suitable—as previously in the same manner—for receiving a printing blanket 33 in the manner described above.

One advantage of changeable segments 32 on segmented wheel 03 is that, e.g. when converting the machine assembly to produce hollow bodies 01 of a different format from the current production run, e.g., to cans having a shorter or longer can height and/or a different can diameter, an adjustment in the format of the printing blankets 33 required for printing can be carried out faster and more easily. In a machine assembly having a segmented wheel 03 onto which segments 32 are already molded, in order to convert the production process to hollow bodies 01 of a different format, the entire segmented wheel 03 must be replaced; considering the typical size of segmented wheel 03 with an outer diameter in the range of 1,400 mm to 1,600 mm, for example, and/or the typical weight of more than 500 kg, in particular more than 1,000 kg, for example, this requires considerable effort and unreasonably long setup times.

To produce a printed image of high print quality on hollow bodies 01 in the printing process, a segmented wheel 03 must meet very strict requirements in terms of concentricity, meaning that such a segmented wheel 03 must be machined very accurately, i.e., with low permissible manufacturing tolerances. With a segmented wheel 03 onto which segments 32 are already molded, this is expensive and requires great effort due to the relatively large outer diameter of 1,400 mm to 1,600 mm, for example. What can be accomplished during an initial production process by means of relatively rare and costly large-scale machining equipment is possible in the event of damage to the segments 32 or other parts of segmented wheel 03 only by means of highly costly repair measures that are extremely difficult to perform in the machine assembly, such as leveling, cutting, welding and grinding the damaged area, or by replacing the entire segmented wheel 03. For the operator of such a machine assembly, in addition to high repair costs this means long production downtimes, since the entire machine assembly is shut down for the duration of the repairs. Finally, with integral segmented wheels 03, no variation in the materials used, e.g. to decrease the inertia of the segmented wheel 03 in question, is possible.

Figure 19:
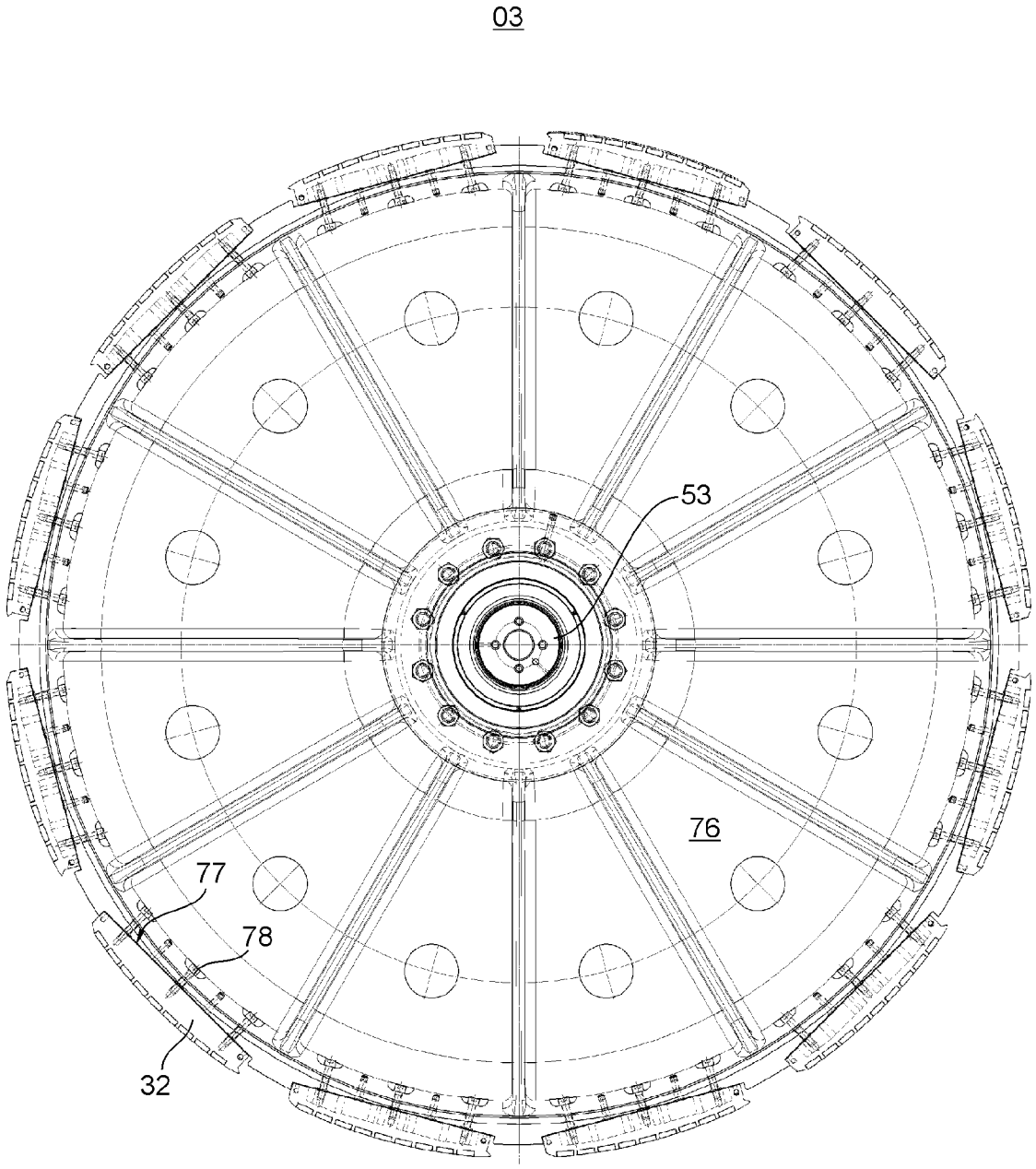
FIG. 19 shows the segmented wheel with replaceable segments.

A segmented wheel 03 having a plurality of segments 32 arranged along the periphery of its main body 76, in particular spaced from one another, each at a joint 77 as seen in FIG. 19, and thus changeable, simplifies manufacturing of the segmented wheel 03 in question, and its modular construction facilitates its adaptation to different formats dependent on the respective production process, and if necessary, facilitates the repair of damaged areas on said segmented wheel 03, in particular on the segments 32 thereof, to be performed in the machine assembly.

Figure 20:
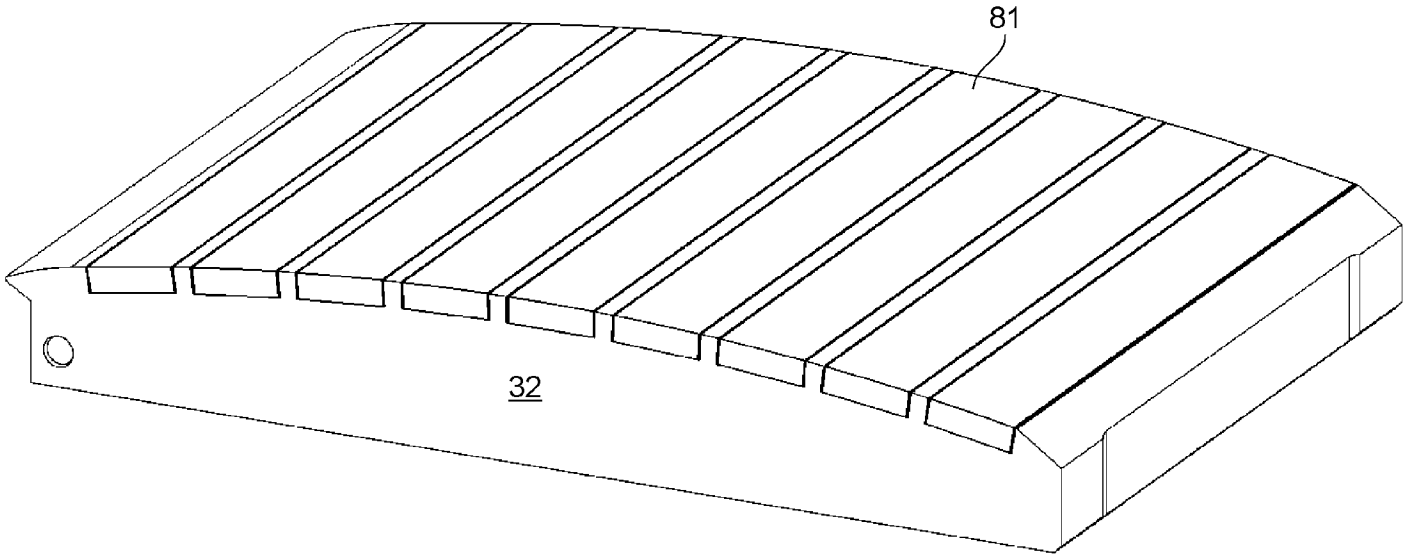
FIG. 20 shows a single changeable segment.

In the embodiment of segmented wheel 03 shown in FIG. 19, the individual, changeable segments 32 are preferably configured as finished (FIG. 20). This means that the finished segments 32 need to correspond with high precision to the desired outer diameter of the relevant segmented wheel 03 only in terms of their respective surface curvature. The remaining geometries play a subordinate role in terms of tolerances. In the main body 76 of segmented wheel 03, the manufacturing tolerances of the outer geometry are likewise subordinate in importance. The individual segment 32 shown by way of example in FIG. 20 has, e.g., at least one holding magnet 81 for holding a printing blanket 33 having a magnetizable metal substrate on the periphery of the segmented wheel 03, in particular in the proper position, after said segment 32 has been mounted on the main body 76 of said segmented wheel 03.

Figure 19A:
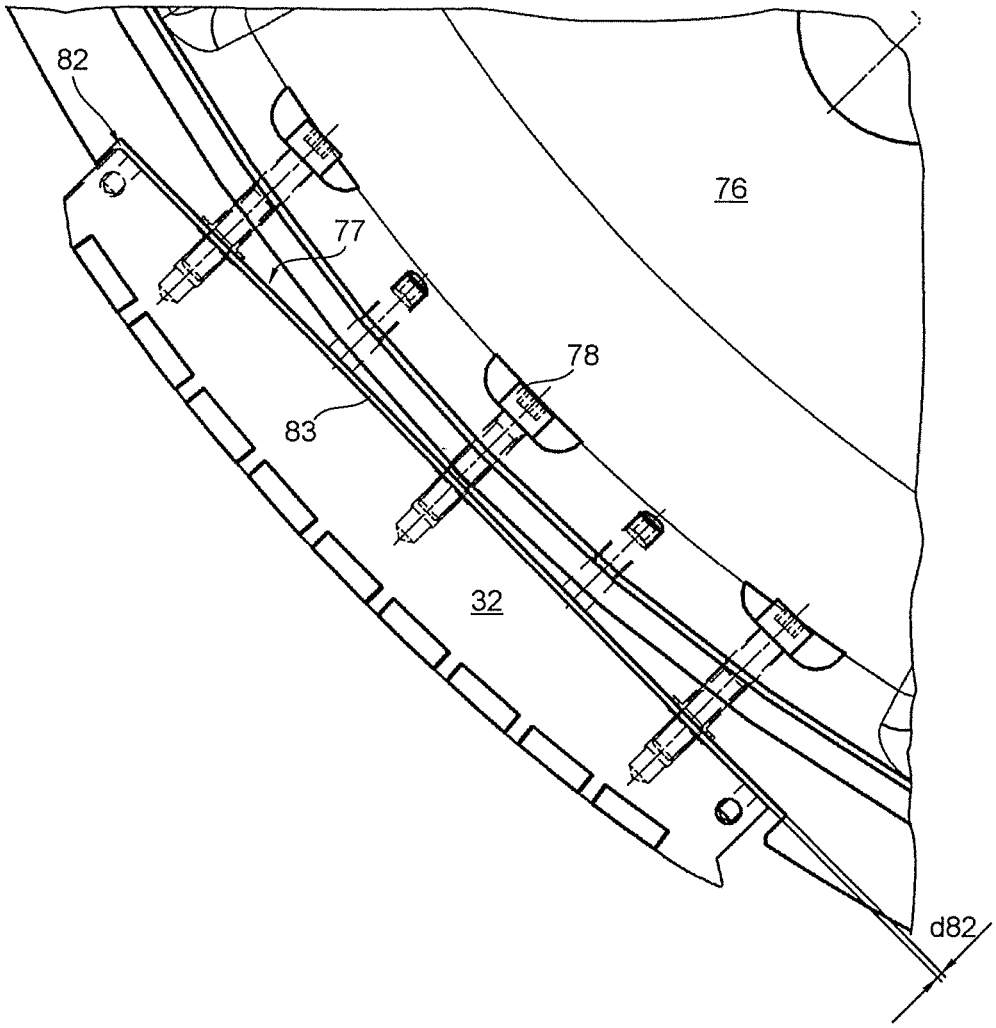
FIG. 19*a* shows an enlarged portion of the segmented wheel.

The required high accuracy in terms of the concentricity and radius of the respective running surfaces of the relevant printing blankets 33 is achieved by a process of aligning the segments 32, performed, e.g. with the aid of a rider gauge 79 that is movable in particular along the periphery of the segmented wheel 03 (FIG. 14), while main body 76 of segmented wheel 03 is disposed in the machine assembly, and is fixed, e.g. by casting a compensation gap 82, as seen in FIG. 19*a*. At each relevant joint 77 between a respective segment 32 and the main body 76, a compensation gap is formed, with a joint face coating 83 arranged in the relevant compensation gap 82, said joint face coating 83 preferably being formed as, e.g., a low-viscosity casting material or as a filler compound. Each respective segment 32 is thus cast in particular to fit precisely at its joint 77 with main body 76 of segmented wheel 03. At the joint 77 in question, the compensation gap 82 has a gap width d82 of, e.g., at least 1 mm up to, e.g., 5 mm. In addition, each of the segments 32 is fixed to main body 76 and/or is detachably connected to main base body 76, e.g. by means of at least one connecting element 78. The at least one connecting element 78 that connects each respective segment 32 to the main body 76 of segmented wheel 03 is configured in each case, e.g., as a cylindrical screw or as a tapered pin.

A joint face coating 83 is used to adapt and fit machine parts with the most stringent requirements in terms of precision. It allows adaptations within the μm range without costly mechanical preliminary treatment or post-treatment. It has a high static compression resistance of, e.g., 100 $N/mm^2$ and/or a contact area ratio of, e.g., 100%. A joint face coating 83 has very high adhesive force and cures without technically relevant shrinkage. A joint face coating of this type is available, e.g., from SKC Gleittechnik GmbH in D-96469 Roedental.

Advantageously, with the above-described device for printing on hollow bodies 01, a so-called "flying production change" can be carried out, i.e. a change is made from a first printing process to a second printing process without an interruption of production. As long as a printing blanket change is not required, production is switched over while segmented wheel 03 continues, i.e., rotates without interruption, and proceeds with printing on hollow bodies 01. In a machine assembly in which several thousand of these hollow bodies 01 are produced per minute, e.g., between 1,500 and 3,000 pieces per minute, an uninterrupted change in production means an enormous increase in efficiency. And even if a change of at least one of the printing blankets is required with the production change, the makeready times for the decorator can be shortened considerably by the following method.

Thus, a method for operating a device for printing on hollow bodies 01 is proposed, said device having a segmented wheel 03 that rotates about its axis 34 and has a plurality of printing blankets 33 arranged in a row along its periphery, and having a plurality of plate cylinders 04, preferably in a star-shaped assignment to said segmented wheel 03, i.e., on the periphery thereof, and each bearing a printing forme or a printing plate 68, wherein a specific printing ink is supplied to each of these plate cylinders 04 for inking up its printing forme or its printing plate 68, in each case by means of an inking unit 06 preferably configured as a short inking unit and having a roller train, in particular comprising two rollers. Depending on the printing process to be executed for printing on the hollow bodies 01, a selected set of plate cylinders 04 are thrown, e.g. radially, onto segmented wheel 03 or are thrown off of said segmented wheel 03. In a first printing process, each of a first subset of plate cylinders 04, each bearing an inked-up printing forme or an inked-up printing plate 68 and thrown onto the rotating segmented wheel 03, transfers printing ink onto a plurality of the printing blankets 33 arranged on said segmented wheel 03. Upon completion of the first printing process, at least some of the plate cylinders 04 thrown onto segmented wheel 03 in the first printing process are thrown off of said rotating segmented wheel 03. To execute a second printing process that is different from the first printing process, while segmented wheel 03 continues to rotate without interruption, a second subset of plate cylinders 04, each bearing an inked-up printing forme or an inked-up printing plate 68, is then thrown, in particular radially, onto said segmented wheel 03, so that each of these plate cylinders 04 transfers printing ink onto a plurality of the printing blankets 33 arranged on said segmented wheel 03. The printing blankets 33 in turn transfer the respective printing ink onto hollow bodies 01 to be printed, which are advanced to the rotating segmented wheel 03, e.g. by means of a mandrel wheel 02.

In a preferred embodiment, when the first printing process is completed, those inking units 06 that supplied printing ink to the first subset of plate cylinders 04 in the first printing process are each thrown off of this first subset of plate cylinders 04. In addition, at the start of the second printing process, those inking units 06 that will supply printing ink to the second subset of plate cylinders 04 in the second printing process are each thrown onto this second subset of plate cylinders 04.

The rotation of segmented wheel 03 is preferably driven separately, as described above, i.e., at least independently of the plate cylinders 04 and/or the inking units 06, by a motor 58 configured, e.g., as a direct drive. Each of the plate cylinders 04 that is or at least can be thrown onto segmented wheel 03 is also rotationally driven separately, i.e. at least independently of segmented wheel 03, by a motor 11. Each of the inking units 06 has exactly one ink forme roller 07 that is or can be thrown onto the relevant plate cylinder 04, or is or can be thrown off of said plate cylinder 04, and, e.g., one anilox roller 08 that conveys printing ink to the ink forme roller 07 in question, wherein the respective ink forme roller 07 and optionally the relevant anilox roller 08 are each rotationally driven independently, i.e., separately, by a motor 12. Alternatively, each respective ink forme roller 07 may be rotationally driven by friction, e.g. by the respective anilox roller 08 located in the same inking unit 06. The aforementioned separate drives 11; 12; 58, i.e., the motor 58 that separately drives the rotation of segmented wheel 03 and/or the respective motor 11 that separately drives the rotation of the respective plate cylinder 04 and/or the motor 12 that separately drives the rotation of the respective ink forme roller 07 and/or the anilox roller 08 is or are preferably each controlled or regulated, independently and preferably individually, by a control unit. The respective throwing on and/or throwing off of the relevant plate cylinders 04 and/or the relevant inking units 06 is preferably also controlled by the control unit, each independently of the others and each dependent upon the printing process to be carried out.

To shorten makeready times, the respective printing forme or the respective printing plate 68 on at least one plate cylinder 04 that is not involved in the printing process currently running, i.e. that is not currently thrown onto the rotating segmented wheel 03, is preferably changed automatically during said running printing process, in each case using a plate changer 14, e.g. as described above. To change at least one of the printing blankets 33 arranged on segmented wheel 03, segmented wheel 03 is brought to a standstill, and at least one printing blanket 33 arranged on this segmented wheel 03 is preferably changed automatically using a device for automatically changing the printing blankets 33.

Furthermore, the above-described device for printing on hollow bodies 01 can be used to carry out a method for printing on hollow bodies 01, in which printing ink is transferred onto each of the hollow bodies 01, in each case by one of the printing blankets 33 arranged in a row along the periphery of a segmented wheel 03 rotating about its axis 34, in which at least two plate cylinders 04, arranged in succession in the direction of rotation of segmented wheel 03 and each bearing a printing plate 68, are used, in which a first printing ink applied by a first inking unit 06, which is engaged against a first plate cylinder 04, onto the printing plate 68 of said cylinder is transferred onto a first printing blanket 33 of the printing blankets 33 arranged on the periphery of segmented wheel 03, and from there is back-split, i.e. transferred by back-splitting, onto the printing plate 68 of a second plate cylinder 04 situated downstream of the first plate cylinder 04 in the direction of rotation of segmented wheel 03. With a second inking unit 06 engaged on the second plate cylinder 04, a second printing ink different from the first printing ink is applied to the printing plate 68 of said second plate cylinder. The first printing ink applied by back-splitting and the second printing ink applied by the second inking unit 06, each to the printing plate 68 of the second plate cylinder 04, are then transferred together onto a second printing blanket 33 of the printing blankets 33 arranged on the periphery of segmented wheel 03. The different printing inks applied to the printing plate 68 of the second plate cylinder 04 are applied to said printing plate 68 in various adjoining regions, with the printing inks applied to the printing plate 68 of the second plate cylinder 04 blending in their respective border region 71. The printing inks 69 applied to printing plate 68 of the second plate cylinder 04 are then transferred onto the second printing blanket 33, reproducing the blending of said inks that occurs in their respective border region 71.

For inking up the printing plates 68, e.g. a short inking unit, i.e. an inking unit 06 having a roller train consisting of a maximum of five rollers, or in the preferred embodiment an inking unit 06 having a roller train consisting of two rollers 07; 08, said inking unit being thrown onto the respective plate cylinder 04, is used in each case, wherein only a single ink forme roller 07 is assigned to the respective plate cylinder 04 in each case. In each of the respective inking units 06, an ink forme roller 07 the circumferential length of which corresponds to the circumferential length of the respective plate cylinder 04 is used, in particular. Accordingly, in the preferred embodiment, the outer diameter d04 of the plate cylinder 04 bearing the printing plate 68 in question and the outer diameter d07 of the ink forme roller 07 thrown onto said plate cylinder 04 are equal.

For inking up the first plate cylinder 04, e.g. a fully sheathed ink forme roller 07 is used. For inking up the second plate cylinder 04, e.g. a fully sheathed ink forme roller 07 or preferably a coated ink forme roller 07 with depressions introduced on its lateral surface is used, these depressions being formed based, in particular, upon the printing image to be printed and/or, e.g. in the axial direction and/or in the circumferential direction. For printing on the hollow bodies 01, e.g. printing blankets 33 in which depressions are introduced may be used. The depressions in the lateral surface of the ink forme roller 07 used for inking up the second plate cylinder 04 and/or in the printing blankets 33 used for printing the hollow bodies 01 are introduced in each case, e.g. by mechanical engraving or by milling or by lasers.

In the preferred embodiment, the first inking unit 06 inks up at least one planar first printing image area formed on printing plate 68 of the first plate cylinder 04, and the second inking unit 06 inks up at least one planar second printing image area formed on printing plate 68 of the second plate cylinder 04. Due to its position and size, the second printing image area formed on printing plate 68 of the second plate cylinder 04 encompasses the region in which printing ink is transferred or back-split from the respective surface of the at least one first printing image area formed on printing plate 68 of the first plate cylinder 04. And the ink forme roller 07 of the second inking unit 06, which is used for inking up printing plate 68 of the second plate cylinder 04, has in its lateral surface a depression as described above in the respective surface that corresponds to the at least one first printing image area of printing plate 68 arranged on the first plate cylinder 04.

The respective circumferential speeds of the first plate cylinder 04 and of the ink forme roller 07 that inks up the printing plate 68 arranged on this first plate cylinder 04, and the respective circumferential speeds of the second plate cylinder 04 and of the ink forme roller 07 that inks up the printing plate 68 arranged on this second plate cylinder 04 are synchronized with one another, e.g. by a control unit, in particular with respect to a common reference point. Therefore, each plate cylinder 04 and its associated ink forme roller 07 are synchronized. To produce the intended ink gradients, this synchronization must exist for all printing units 73 and inking units 06 that are involved in production, at any given time during the relevant production process, i.e., including immediately following a machine stop. In addition, the respective circumferential speeds of the hollow bodies 01 to be printed and of segmented wheel 03 are synchronized with one another.

With this method, in the execution of a letterpress printing process, color gradients known as rainbow printing effects are produced, with which the design depth achievable in printing can be increased and/or security features can be produced. The selective use of color gradients allows totally novel decorative patterns to be produced on hollow bodies 01, in the axial direction and/or the circumferential direction thereof. This is possible with the described method even using short inking units, including such inking units that have a roller train with, e.g. only two rollers.

Figure 17:
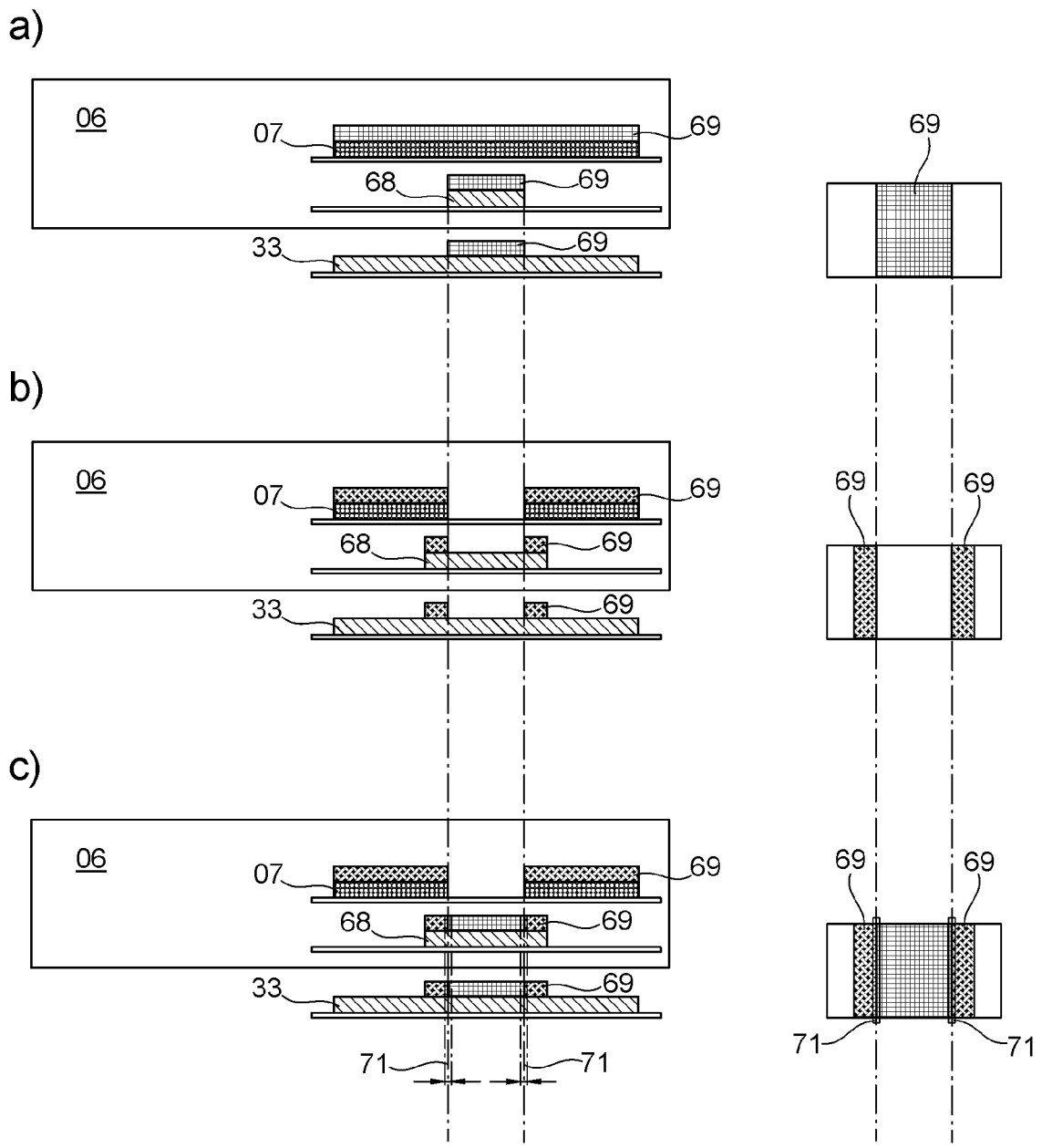
FIG. 17 shows a production sequence for producing a color gradient on a hollow body.

FIG. 17 shows three phases of a production sequence for producing a color gradient on a hollow body 01, with at least two inking units 06 being used in this device for printing on hollow bodies 01, each inking unit having an ink forme roller 07, the respective circumferential length of which is equal to the flat length of the printing plate 68 used in the same inking unit 06. In a first production phase (FIG. 17*a*), in a first inking unit 06 having a first, e.g. fully sheathed, ink forme roller 07, a first printing ink 69 is applied to a first printing plate 68 arranged on a first plate cylinder 04. The first printing plate 68 then rolls off onto a first printing blanket 33 that is cooperating with the first plate cylinder 04 and is arranged on the segmented wheel 03, which is rotating about its axis 34, thereby producing the ink application shown in FIG. 17*a* in both a sectional view and a plan view on said first printing blanket 33. In a second production phase (FIG. 17*b*), in a second inking unit 06 that has a second ink forme roller 07 having, e.g. a depression in the circumferential direction, a second printing ink 69 is applied to a second printing plate 68 arranged on a second plate cylinder 04. The second printing plate 68 then rolls off onto a second printing blanket 33 that is cooperating with the second plate cylinder 04 and is likewise arranged on the rotating segmented wheel 03, thereby producing the ink application shown in FIG. 17*b* in both a sectional view and a plan view on said second printing blanket 33. FIG. 17*c* shows, by way of example, a third production phase in which both the first printing ink 69 and the second printing ink 69 are applied to mutually adjoining regions of the printing plate 68 arranged on the second plate cylinder 04, the first printing ink 69 having been applied to the second printing plate 68 by back-splitting. By transferring the two printing inks 69 together onto the second printing blanket 33 cooperating with the second plate cylinder 04, the ink application shown in FIG. 17*c* in both a sectional view and a plan view is produced, in which in each respective boundary region 71 between the two printing inks 69 applied to the second printing blanket 33, a mixing of inks caused by back-splitting is produced, forming a color gradient or a rainbow printing effect. This color gradient can then be transferred onto the hollow body 01 to be printed.

Another highly advantageous method for printing on hollow bodies includes the method steps in which printing ink 69 is transferred onto each of the hollow bodies 01 by a different one of the printing blankets 33 arranged in a row along the periphery of a segmented wheel 03 rotating about its axis 34, in which case printing ink 69 is applied to the relevant printing blanket 33 by a plurality of printing units 72; 73 arranged along the periphery of segmented wheel 03. In that case, in the direction of rotation of segmented wheel 03, a first subset of printing units 73 applies printing ink 69 in a contact process, preferably in a letterpress process but possibly also in a screen printing process or an offset printing process, to the relevant printing blanket 33, and each of a second subset of printing units 72 applies printing ink 69 in a plateless digital printing process to the relevant printing blanket 33, wherein all of the printing inks 69 that will ultimately be transferred from the respective printing units 72; 73 onto the hollow body 01 in question are first collected on the relevant printing blanket 33 and are then transferred together from the relevant printing blanket 33 onto the hollow body 01 in question. In that case, the printing unit 72 applying at least one printing ink 69 in a plateless digital printing process onto the relevant printing blanket 33 is preferably located within an angular range $\varphi$ of $\pm 45°$ with respect to the zenith of segmented wheel 03, and thus in an upper region of said segmented wheel 03. At least one inkjet print head 74 or one laser is advantageously used for the printing unit 72 applying at least one printing ink 69 in a plateless digital printing process onto the relevant printing blanket 33. It is particularly advantageous for each printing unit 72 applying at least one printing ink 69 in a plateless digital printing process onto the relevant printing blanket 33 to be in the form of a double array, i.e. a printing unit 72 in which two printing devices, e.g. two inkjet print heads 74, each preferably applying the same printing ink to the relevant printing blanket 33, are arranged in a row in the circumferential direction of segmented wheel 03. As an alternative to the double array, a single array or some other multiple array may be used. Thus, the printing unit 72 applying at least one printing ink 69 in a plateless digital printing process to the relevant printing blanket 33 applies at least one of the printing inks cyan and/or magenta and/or yellow and/or black. Each of the printing units 73 applying the printing ink 69 in a letterpress printing process or in a screen printing process or in an offset printing process onto the relevant printing blanket 33 preferably applies a particular premixed, e.g. customized or product specific special ink. For the precise angular position control of segmented wheel 03, it is advantageous for the rotation of segmented wheel 03 to be driven by a direct drive configured as a motor 58. As described above, in the preferred embodiment the hollow bodies 01 to be printed on are advanced to the rotating segmented wheel 03 by a mandrel wheel 02 rotating counter to segmented wheel 03 about an axis 41, and the relevant printing blanket 33 with the printing inks 69 collected thereon rolls off against the relevant hollow body 01, transferring said printing inks 69 onto said hollow body. In addition, to shorten makeready times, at least one printing blanket 33 arranged on segmented wheel 03 can be changed automatically using a device for automatically changing printing blankets 33. Each printing unit in the first subset of printing units 73 that print, e.g. in a letterpress printing process uses an inking unit 06 that is thrown onto the respective plate cylinder 04 and that has a roller train consisting of a maximum of five rollers, i.e., preferably a short inking unit. Alternatively or additionally, each printing unit in the first subset of printing units 73 that print, e.g. in a letterpress printing process uses an inking unit 06 that is thrown onto the respective plate cylinder 04 and that has only a single ink forme roller 07.

Figure 18:
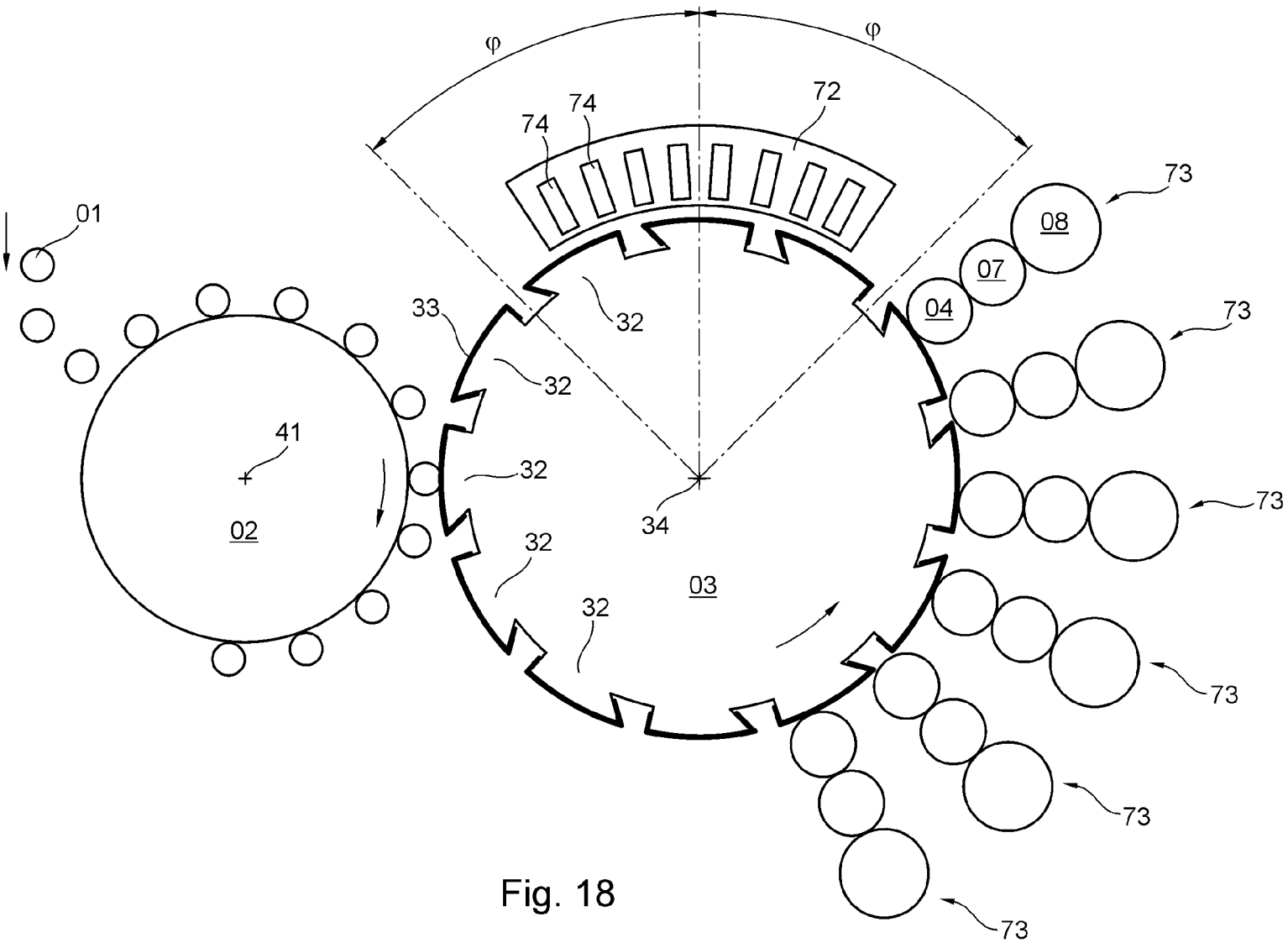
FIG. 18 shows a hybrid device for printing on hollow bodies.

FIG. 18 shows a schematic diagram of the device for printing on hollow bodies 01, having one printing unit 72 that prints in a multi-color, e.g. four-color, plateless digital printing process and having a plurality of printing units 73, e.g. six, each of which prints in a letterpress printing process or in a screen printing process or in an offset printing process. The result is a hybrid device for printing on hollow bodies 01, with which even smaller print runs or batch sizes of hollow bodies 01 that entail more frequent changes to the decorative pattern in the device for printing on hollow bodies 01 can very advantageously be efficiently produced.

While a preferred embodiment of a segmented wheel of a device for printing on hollow bodies, in accordance with the present invention, has been set forth fully and completely herein above, it will be apparent to one of skill in the art that various changes could be made thereto, without departing from the true spirit and scope of the subject invention, which is accordingly to be limited only by the appended claims.

The invention claimed is:

1. A segmented wheel for a device for printing on hollow bodies comprising:

a plurality of segments positioned on a periphery of the segmented wheel;

a printing blanket for printing on the hollow bodies, the printing blanket one of is arranged and is able to be arranged on at least one segment of the plurality of segments;

a main body of the segmented wheel, the main body being a metallic material, wherein each of the plurality of segments is arranged along the periphery of the main body of the segmented wheel at a joint, wherein the plurality of segments are each detachably connected to the main body, wherein the plurality of segments are changeable on the main body of the segmented wheel, whereby the segmented wheel is adaptable to different formats of the hollow bodies, which different formats are dependent upon a production run, wherein different formats of the hollow bodies refer to one of a shorter hollow body height, a taller hollow body height and a hollow body diameter that is different from a format of hollow bodies in a current production run, whereby each of the plurality of segments has at least one holding magnet usable to hold one printing blanket and wherein each said printing blanket has a magnetizable metal substrate.

2. The segmented wheel according to claim 1, wherein at a joint between a segment of the plurality of segments and the main body, a compensation gap, having a joint face coating, is formed.

3. The segmented wheel according to claim 2, wherein the joint face coating is a casting material.

4. The segmented wheel according to claim 2, wherein the joint face coating is embodied as a casting material that cures without shrinkage.

5. The segmented wheel according to claim 1, wherein each of the plurality of segments is cast to fit, at its joint, with the main body of the segmented wheel.

6. The segmented wheel according to claim 2, wherein the compensation gap at the joint between a segment of the plurality of segments, and the main body has a gap width between 1 mm and 5 mm.

7. The segmented wheel according to claim 1, wherein each of the plurality of segments is fixed to the main body by at least one connecting element.

8. The segmented wheel according to claim 1, wherein the segmented wheel has an outer diameter between 1400 mm and 1600 mm and has a weight of more than 500 kg.

9. The segmented wheel according to claim 1, wherein the plurality of segments are each embodied as finished, and wherein a surface curvature of each of the finished plurality of segments corresponds to an outer diameter of the segmented wheel.

10. The segmented wheel according to claim 1, wherein the main body of the segmented wheel one of is made of cast iron and is configured as a welded structure.

11. The segmented wheel according to claim 1, wherein the segmented wheel has eight to twelve of the plurality of segments, spaced equidistant from one another, in a row along the periphery of the segmented wheel.

12. A device for printing on hollow bodies, having the segmented wheel with the plurality of segments along its periphery, according to claim 1, and wherein the segmented wheel has a shaft which is mounted in a frame of said device.

13. The device according to claim 12, wherein rotation of the segmented wheel is driven by a direct drive connected to the shaft of the segmented wheel.

14. The device according to claim 13, wherein the direct drive is one of a permanently energized brushless DC motor and a torque motor.

15. The device according to claim 12, wherein the shaft of the segmented wheel is mounted in the frame, at ends of said shaft, in double-row roller bearings.

16. The device according to claim 12, wherein the segmented wheel is connected rigidly to the shaft by clamping elements, and is fixed on the shaft.

* * * * *